US007788953B1

(12) United States Patent
McMurray et al.

(10) Patent No.: US 7,788,953 B1
(45) **Date of Patent: *Sep. 7, 2010**

(54) DOUBLE FACED WEFT-KNIT TEXTILE ARTICLE

(75) Inventors: Brian L. McMurray, Aberdeen, NC (US); Robert Thomas Spillane, Lincolnton, NC (US); Harold Frederick Kegley, Mebane, NC (US)

(73) Assignee: McMurray Fabrics, Inc., Aberdeen, NC (US)

( * ) Notice: Subject to any disclaimer, the term of this patent is extended or adjusted under 35 U.S.C. 154(b) by 911 days.

This patent is subject to a terminal disclaimer.

(21) Appl. No.: 11/591,714

(22) Filed: Nov. 2, 2006

Related U.S. Application Data

(63) Continuation-in-part of application No. 11/249,774, filed on Oct. 13, 2005, now Pat. No. 7,707,857.

(51) Int. Cl.
*D04B 7/04* (2006.01)

(52) U.S. Cl. ..... 66/196

(58) Field of Classification Search ..... 66/196, 66/198, 197, 200, 25
See application file for complete search history.

(56) References Cited

U.S. PATENT DOCUMENTS

| | | | | | |
|---|---|---|---|---|---|
| 1,801,825 | A | | 4/1931 | Plush | 66/192 |
| 2,067,739 | A | * | 1/1937 | Tanski | 66/196 |
| 2,696,723 | A | | 12/1954 | Frith | 66/192 |
| 2,957,327 | A | | 10/1960 | Glover | 66/191 |
| 3,043,124 | A | | 7/1962 | Hubbard | 66/191 |
| 3,264,846 | A | * | 8/1966 | Pfrommer | 66/196 |
| 3,609,999 | A | * | 10/1971 | Blore | 66/96 R |
| 3,626,714 | A | * | 12/1971 | Blore | 66/196 |
| 3,710,598 | A | | 1/1973 | Wilkens | 66/192 |
| 3,808,843 | A | * | 5/1974 | Blore et al. | 66/196 |
| 3,971,234 | A | | 7/1976 | Taylor | 66/200 |
| 4,267,710 | A | * | 5/1981 | Imamichi | 66/196 |
| 4,296,498 | A | | 10/1981 | Vinson | 2/115 |
| 4,310,929 | A | | 1/1982 | Finlay | 2/238 |
| 4,353,229 | A | * | 10/1982 | Hutchinson et al. | 66/197 |
| 4,414,691 | A | | 11/1983 | Estruch | 2/67 |
| 4,567,075 | A | | 1/1986 | Krawczyk | 428/91 |
| 4,712,281 | A | | 12/1987 | Scheller | 28/162 |
| 4,811,573 | A | | 3/1989 | Sternlieb | 66/193 |
| 4,881,383 | A | | 11/1989 | Spillane | 66/194 |
| 4,941,331 | A | * | 7/1990 | Cournoyer et al. | 66/25 |
| 5,029,457 | A | | 7/1991 | Gajjar | 66/195 |
| 5,204,995 | A | | 4/1993 | Knapp | 2/228 |

(Continued)

OTHER PUBLICATIONS

Raz, S., Warp Knitting Production, Melliand Textilberichte GmbH, Rohrbacher Str. 76, D-6900 Heidelberg, Germany 1987. pp. 202-203.

*Primary Examiner*—Danny Worrell
(74) *Attorney, Agent, or Firm*—MacCord Mason PLLC

(57) ABSTRACT

A double face, weft-knit textile garment. The garment includes: a first face having a printed portion; and a second face having a printed portion, wherein the fabric density of the fabric forming the garment is greater than about 5 oz. per square yard, thereby substantially preventing grin through from at least one printed portion to the opposite face. In one embodiment of the invention, a plurality of openings are formed in both faces for breathability. In addition, the garment may further include at least one body anchor for facilitating attachment of the garment to the wearer.

67 Claims, 14 Drawing Sheets

U.S. PATENT DOCUMENTS 5,463,881 A * 11/1995 Igarashi et al. ..... 66/31
5,528,910 A 6/1996 Azais ..... 66/197
5,561,860 A 10/1996 Nguyen-Senderowicz ..... 2/90
5,657,648 A 8/1997 Ives ..... 66/193
5,727,401 A 3/1998 Stafham ..... 66/176
5,855,125 A 1/1999 Lohmueller ..... 66/196
5,916,273 A 6/1999 Hepfinger ..... 66/194
6,006,550 A 12/1999 Singh ..... 66/13
6,131,419 A 10/2000 Rock et al. ..... 66/194
6,196,032 B1 3/2001 Rock et al. ..... 66/195
6,199,410 B1 3/2001 Rock et al. ..... 66/195
6,427,493 B1 8/2002 Kasdan et al. ..... 66/169 R
6,446,472 B2 9/2002 West et al. ..... 66/193
6,526,783 B2 * 3/2003 Sheu ..... 66/22
6,622,528 B2 * 9/2003 Masse et al. ..... 66/22
6,634,190 B2 10/2003 Didier-Laurent ..... 66/196
6,647,551 B2 11/2003 Palumbo ..... 2/69
6,854,296 B1 2/2005 Miller, III ..... 66/190
6,871,515 B1 * 3/2005 Starbuck et al. ..... 66/169 R
2003/0126894 A1 7/2003 Masse et al. ..... 66/196
2004/0048540 A1 3/2004 Dailly ..... 442/308
2005/0112976 A1 5/2005 McMurray et al. ..... 442/306

* cited by examiner

*Smaller Mesh Repeat / More Holes*

*6 Needle Repeat x 20 Feeds*

*Example Of Forming Stripe By Removing Mesh Hole Openings*

DOUBLE FACED WEFT-KNIT TEXTILE ARTICLE

CROSS-REFERENCE TO RELATED APPLICATIONS

The present application is a Continuation-in-Part of U.S. Ser. No. 11/249,774, filed Oct. 13, 2005, now U.S. Pat. No. 7,707,857, issued May 4, 2010, which is hereby incorporated by reference in its entirety.

BACKGROUND OF THE INVENTION (1) Field of the Invention

The present invention relates generally to weft-knit textile articles and, more particularly, to a double face, weft-knit textile garment having a first face having a printed portion; and a second face having a printed portion, wherein the fabric density of the fabric forming the garment is sufficient to substantially prevent grin through from at least one printed portion to the opposite face.

(2) Description of the Prior Art

Weft-knit fabrics are commonly used for a wide variety of purposes ranging from signage to apparel. Such fabrics are generally desirable because they are durable and easy to manufacture, for example, they may be more cost effective to knit than warp-knit fabrics. They also typically, because of the weft-construction, only have one true face side, or side configured to be an outer facing side in garments, for example. Again, in garments, the side of the fabric for wearing against the body, or the inner side, may have a certain knit or structure that is defined by the weft construction of the fabric, which makes it unsuitable as a face. Because of this constraint, weft-knit fabric is not typically used to make reversible garments or double faced garments.

Double faced garments can be desirable for any number of reasons, such as, for example, use in athletic competitions. For most organized team sports, or team sporting events, members of one team have one colored jersey and members of the other team have another colored jersey. These different colored jerseys allow both players and spectators to differentiate between team members. At pickup sporting events, however, it is rare that participants will be aware of what other players will be wearing prior to the event, so any coordination of jersey color is difficult. Similarly, for some sporting events, such as pickup or celebrity basketball or soccer games for example, there may be frequent short games with players switching back and forth between teams. In such situations, players often switch jerseys, which may be undesirable because it increases the potential for transmission of blood, sweat and bacteria. Alternatively, a player may be required to have two separate jerseys, one for each team, which is also undesirable because it necessitates having another jersey and keeping up with that other jersey during the game.

By using a double faced jersey having, for example, a dark color on one face and a light color on the opposite face, players could easily switch back and forth between teams. Additionally, reversible jerseys may be desirable for sports fans or spectators at sporting events, who could have both "home" and "away" jersey faces in a single garment or article. Achieving this objective is difficult, particularly with knit fabrics, and even more particularly with knit jerseys knit with holes, because printing or dyeing creates excessive color bleed-through or grin-through.

Others have tried to develop double faced reversible knit fabrics for use in various applications. For example, others have made reversible fabrics for use in textile articles by sandwiching two separate fabrics together or by knitting fabrics with different colored threads. Such a fabric construction addresses color-bleed through and grin-through issues, but creates a fabric or garment of such a weight that it may be too heavy to wear during certain activities, e.g., sports activities or hot weather activities. Similarly, others have made reversible fabrics for textile articles out of simplex using warp knitting. Such simplex warp-knit fabrics are desirable because they allow for printing on each side or face of a fabric without substantial grin-through. Simplex warp-knit fabrics are also desirable because they can be warp knit to include openings or holes to promote breathability. For example, it may be desirable to use simplex warp knit fabrics to make high-cost jerseys for professional sports teams. These types of fabrics, however, may be undesirable because of their cost or weight or because of the specificity in their manufacturing process. It would be desirable to produce a fabric, garment or textile article that has many functional similarities to a simplex warp knit fabric, but, that because of novel structural differences, is easier or more economical to produce.

For various other reasons, other related technologies have other shortcomings.

Thus, there remains a need for a new weft-knit textile garment that has a first face having a printed portion; and a second face having a printed portion, wherein the fabric density of the fabric forming the garment is sufficient to substantially prevent grin through from at least one printed portion to the opposite face. A need also exists for a fabric or garment that is weft-knit with a plurality of openings formed in both faces for breathability.

SUMMARY OF THE INVENTION

The present invention is directed to a double face, weft-knit textile garment. The garment includes: a first face having a printed portion; and a second face having a printed portion, wherein the fabric density of the fabric forming the garment is greater than about 5 oz. per square yard, thereby substantially preventing grin through from at least one printed portion to the opposite face. In one embodiment of the invention, a plurality of openings are formed in both faces for breathability. In addition, the garment may further include at least one body anchor for facilitating attachment of the garment to the wearer.

In one embodiment of the invention, the fabric is integrally knit on a double knit knitting machine. Also, the fabric is at least partially knitted of synthetic yarn and preferably is substantially 100% synthetic yarn such as polyester.

In one embodiment of the invention, the openings are substantially symmetrical. The openings are also spaced apart from one another, preferably horizontally and vertically spaced apart from one another. In one embodiment, the openings are substantially equally spaced in the horizontal direction and substantially equally spaced in the vertical direction at a different spacing. In another embodiment, the openings are substantially equally spaced apart and may form a diamond pattern motif The diameter or distance across the opening at its widest point is preferably between about ½ mm and 3 mm.

The fabric is knitted of at least a first yarn and a second yarn. Preferably, the first yarn is a synthetic monofilament yarn having a substantially round cross-section and having a luster between about substantially clear to substantially semi-dull. Embodiments of the present invention may; however, include a multi-filament first yarn. In addition, the denier of the first yarn is between about 15 and 30 and, preferably about 20. Preferably, the second yarn also is a textured yarn and preferably is a multifilament polyester yarn. In addition, the second yarn may have a luster between about substantially clear to full-dull, preferably semi-dull. Preferably, the second yarn has a round cross-section, yet others may prefer to use yarns with other cross sections, such as, for example, trilobal cross sections. Preferably, the denier of the second yarn is between about 100 and 200 and, preferably about 150.

In one embodiment of the invention, the first face and the second face are substantially identical meaning both faces are comprised of technical face needle loops. Preferably, the faces have a stitch density of between about 1300 and 1700 stitches per sq. inch, and even more preferably have a stitch density of about 1500 stitches per sq. inch. In one embodiment of the invention, the fabric density is between about 6 and 7 oz. per square yard and preferably between about 6.2 and 6.7 oz. per square yard and most preferably between about 6.3 and 6.6 oz. per square yard.

In one embodiment of the invention, the article is a garment further including a body anchor for facilitating attachment to the wearer. The body anchor may be a head opening for example for a poncho. The body anchor may be a torso opening for example for a pair of bottoms such as skirts, kilts, shorts and pants. The body anchor may include at least one arm opening for example for a shirt such as a long sleeve, short sleeve, jersey, vest, jacket and coat.

The textile article may be reversible, such that either face of the article is capable of wearing against the body. Similarly, either face of the article, or both faces of the article, may be printed with a color or pattern. Grin-through or color transfer or color bleed through from the printed portion to the opposite face is substantially prevented.

The present invention also includes a fabric having a first face with a first printable portion and a second face with a second printable portion. The fabric of the present inventions may be knitted on a double knit machine using a variety of yarns. The fabric may have a plurality of openings through both faces, which may for example increase breathability and comfort.

Either face of the fabric, or both faces of the fabric, may be printed with a color or pattern. Grin-through or color transfer or color bleed through from the printed portion to the opposite face is substantially prevented.

Accordingly, one aspect of the present invention is to provide a double face, weft-knit textile article comprising: (a) a first face having a printed portion; and (b) a second face having a printed portion, wherein the fabric density of the fabric forming the textile article is greater than about 5 oz. per square yard, thereby substantially preventing grin through from at least one printed portion to the opposite face.

Another aspect of the present invention is to provide a double face, weft-knit fabric (a) a first face having a printable portion; (b) a second face having a printable portion, wherein the fabric density of the fabric is greater than about 5 oz. per square yard, thereby substantially preventing grin through from at least one printable portion to the opposite face; (c) a plurality of openings formed in both faces for breathability; and (d) an opening-yarn positioned in said openings. In some embodiments, the fabric also includes at least one portion without openings, adjacent to said plurality of openings.

Still another aspect of the present invention is to provide a double face, weft-knit textile garment comprising: (a) a first face having a printed portion; (b) a second face having a printed portion, wherein the fabric density of the fabric forming the garment is greater than about 5 oz. per square yard, thereby substantially preventing grin through from at least one printed portion to the opposite face; (c) a plurality of openings formed in both faces for breathability, wherein the openings include an opening-yarn; and (d) a body anchor for facilitating attachment of the garment to the wearer. In some embodiments, the garment may also include at least one portion without openings, adjacent to said plurality of openings.

In a preferred embodiment, the invention includes a double face, weft-knit fabric comprising: (a) a first yarn knitted to form technical face loops on one side of the fabric, the first yarn having a luster between about substantially clear to substantially semi-dull, and a denier of between about 15 and 30; (b) a second yarn knitted to form technical face loops on both fabric sides, the second yarn having multiple filaments, and a denier of between about 100 and 200, wherein the first yarn and second yarn are knitted to have a stitch density of between about 1300 and 1700 stitches per square inch; and (c) a plurality of openings between about ½ mm and 3 mm at their widest point, the openings defined at their perimeter by a tuck of the second yarn, and maintained at a desired size or shape by at least a portion of the first yarn positioned across said opening, thereby forming a fabric having a density between about 6 and 7 oz. per square yard that is printable on both faces, substantially prevents grin through, and is breathable.

These and other aspects of the present invention will become apparent to those skilled in the art after a reading of the following description of the preferred embodiment when considered with the drawings.

BRIEF DESCRIPTION OF THE DRAWINGS

FIG. 12 is a graph showing the relationship between fabric density versus both cost and grin through;

FIG. 13 is a graph showing the relationship between fabric density versus both comfort and grin through;

DESCRIPTION OF THE PREFERRED EMBODIMENTS

Figure 1:
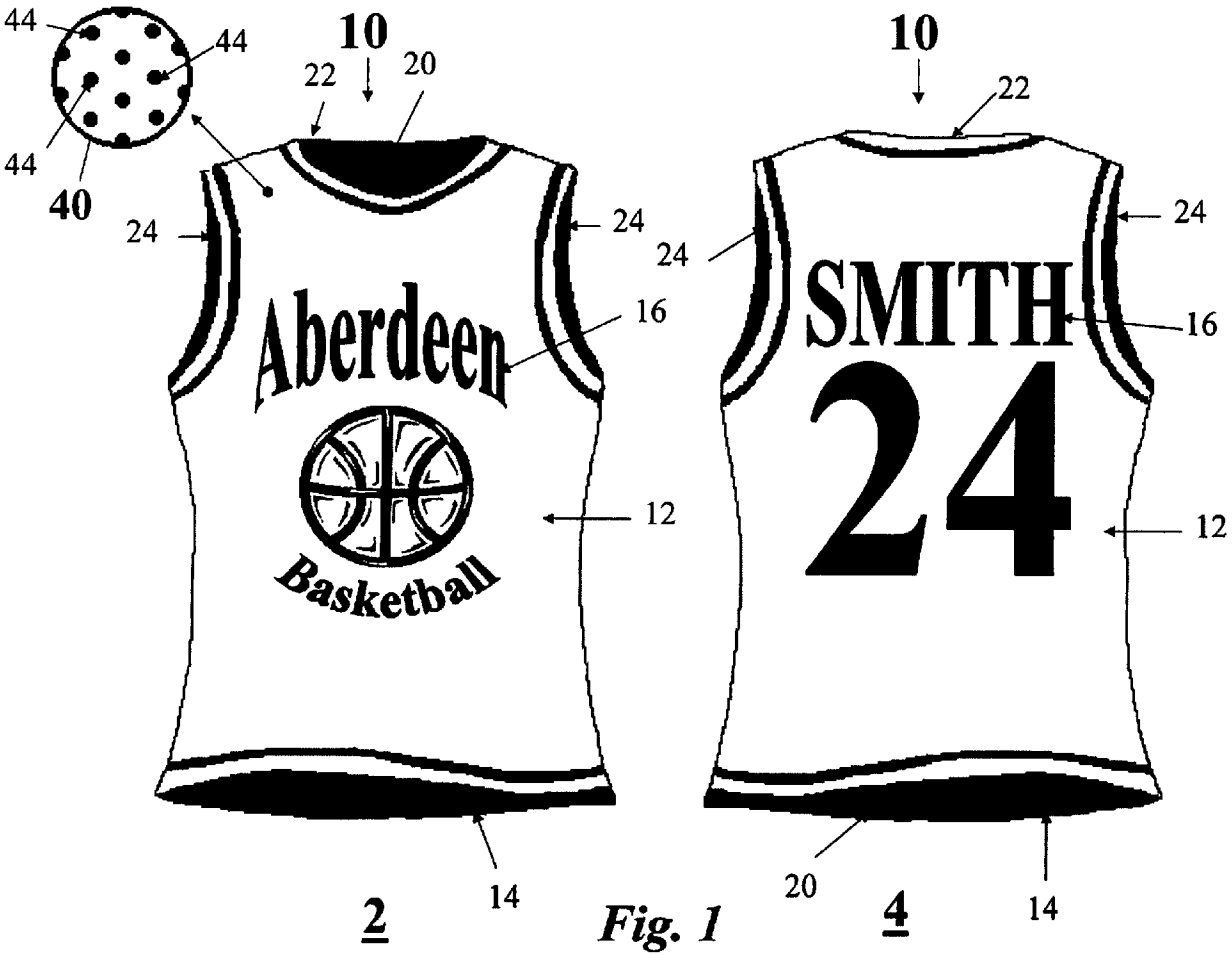
FIG. 1 shows a front and back perspective view of one embodiment of a textile article constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a weft-knit textile article, generally designated 10, is shown constructed according to the present invention. The article includes a front view 2 of the article and a rear view 4 of the article. In this embodiment, the textile article is a jersey.

The jersey 10 has a first face 12 with a first printable portion 16. The jersey 10 also has a second face 14, which in this figure, is the face that would be worn against the body. The second face 14 includes a second printable portion 20, which can be seen in this figure at the interior of the jersey 10. The first printable portion 16 could consist of the displayed text alone or could consist of the displayed text and any part of, or the entire, remaining first face 12 of the article.

Figure 2:
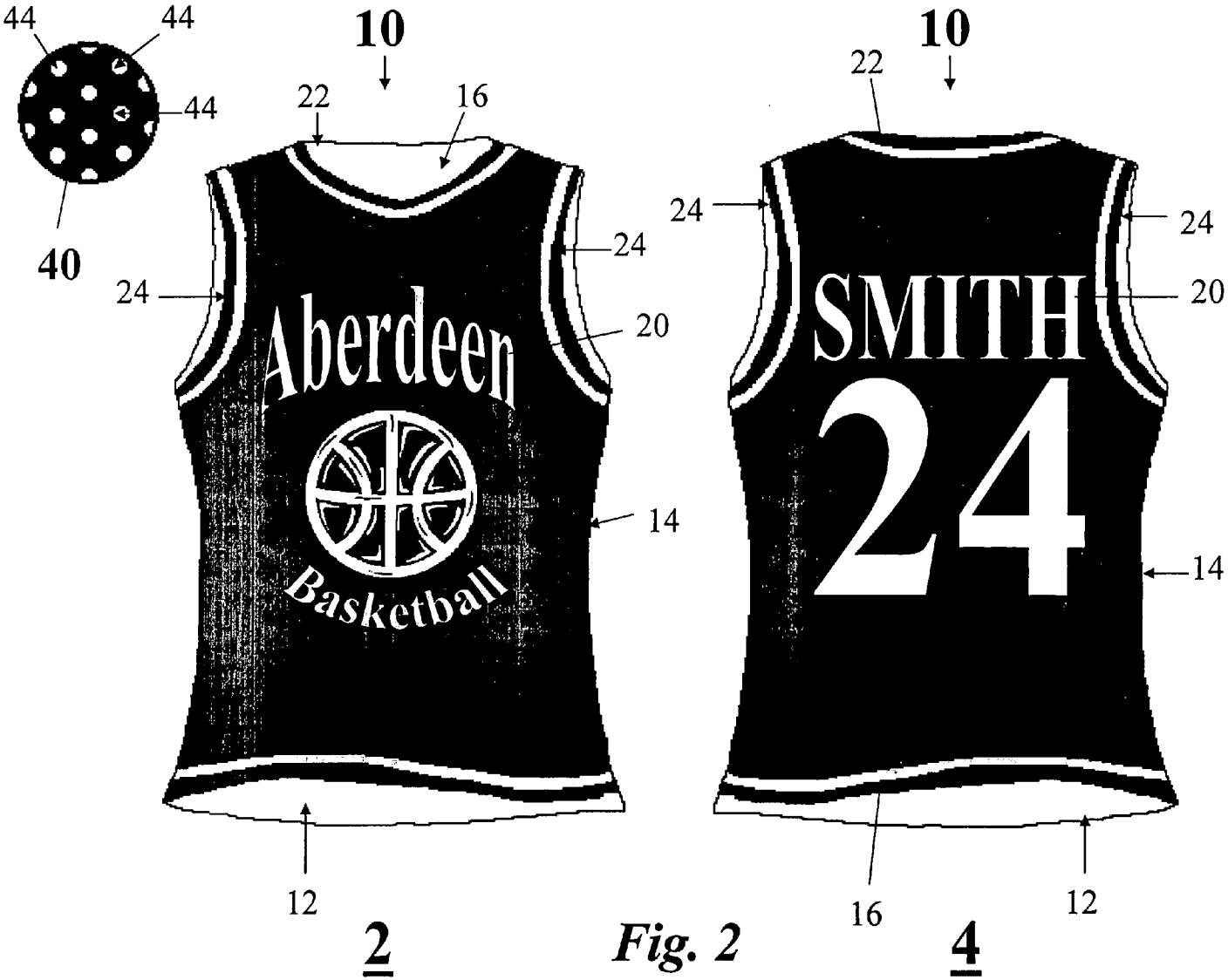
FIG. 2 shows a front and back perspective view of the textile article of FIG. 1, where that textile article has been reversed.

FIG. 2 shows the reversed jersey 10 of FIG. 1, in which the jersey of FIG. 1 is turned inside out. The jersey uses anchors to stay on the wearer's body.

In this case the anchors could be the opening for the head 22 or the openings for the arms 24. The jersey 10 has a second face 14 with a second printable portion 20. The jersey 10 also has a first face 12, which in this figure, is the face that would be worn against the body. The first printable portion 16 of the first face 12 is also visible in this figure.

The first face 12 and the second face 14 of the jersey 10 are substantially integrally formed and have a combined density greater than about 5 oz. per square yard, which substantially prevents grin through from at least one printed portion to the opposite face. For example, by comparing the jersey 10 in FIG. 2 to the jersey 10 in FIG. 1, the prevention of grin-through and transfer is illustrated. In FIG. 2, the second face 14 of the jersey 10 is printed with a light text and dark background at the second printable portion 20. When the jersey 10 is reversed, as in FIG. 1, there is no substantial grin-through or transfer of the dark background or light text. Similarly, in FIG. 2, there is no grin-through or transfer of the light background or dark text from the first printed portion 16 of the first face 12.

Figure 3:
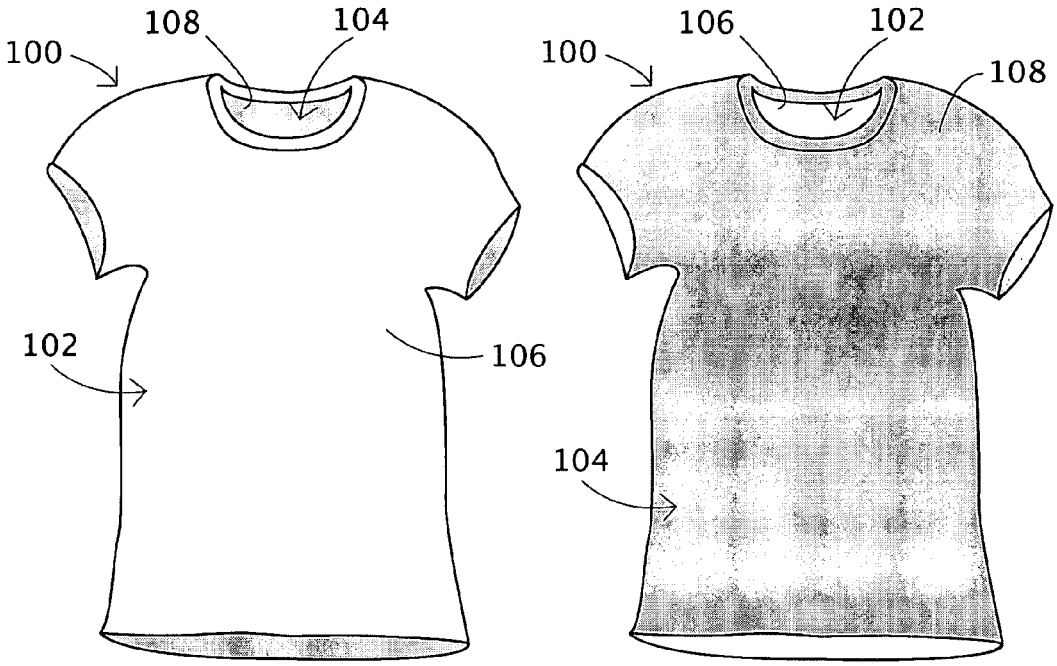
FIG. 3 shows an additional embodiment of the textile article of the present invention.

FIG. 3 shows an additional embodiment of the textile article of the present invention. In this embodiment, the textile article is a shirt 100. The shirt shown is a short sleeved shirt, but the description would apply equally to a long sleeved shirt. The shirt 100 has a first face 102 with a first printable portion 106, and a second face 104 with a second printable portion 108. The first printable portion of the shirt 106 has been printed with a light ink. The second printable portion of the shirt 108 has been printed with a dark ink.

Figure 4:
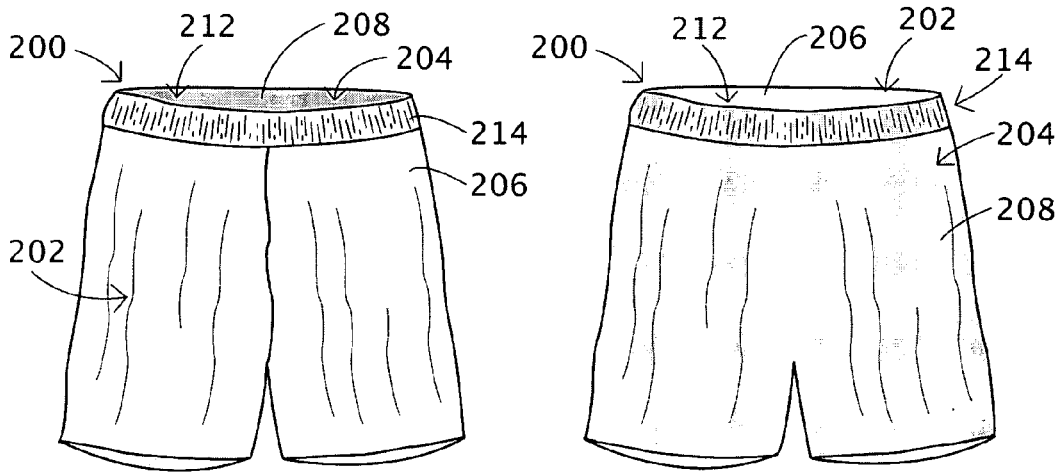
FIG. 4 shows an additional embodiment of the textile article of the present invention.

FIG. 4 shows an additional embodiment of the textile article of the present invention. In this embodiment, the textile article is a pair of pants, specifically short pants or shorts 200. The shorts 200 have an anchor 212 for helping them stay on the wearer's body. In this case the anchor is the opening for the torso 212. An elastic waist band 214 or a similar anchor-tightener, such as a belt (not shown) may be used to further facilitate anchoring the article to the wearer's body. The shorts 200 have a first face 202 with a first printable portion 206, and a second face 204 with a second printable portion 208. The first printable portion of the shorts 206 has been printed with a light ink. The second printable portion of the shorts 208 has been printed with a dark ink.

Figure 5:
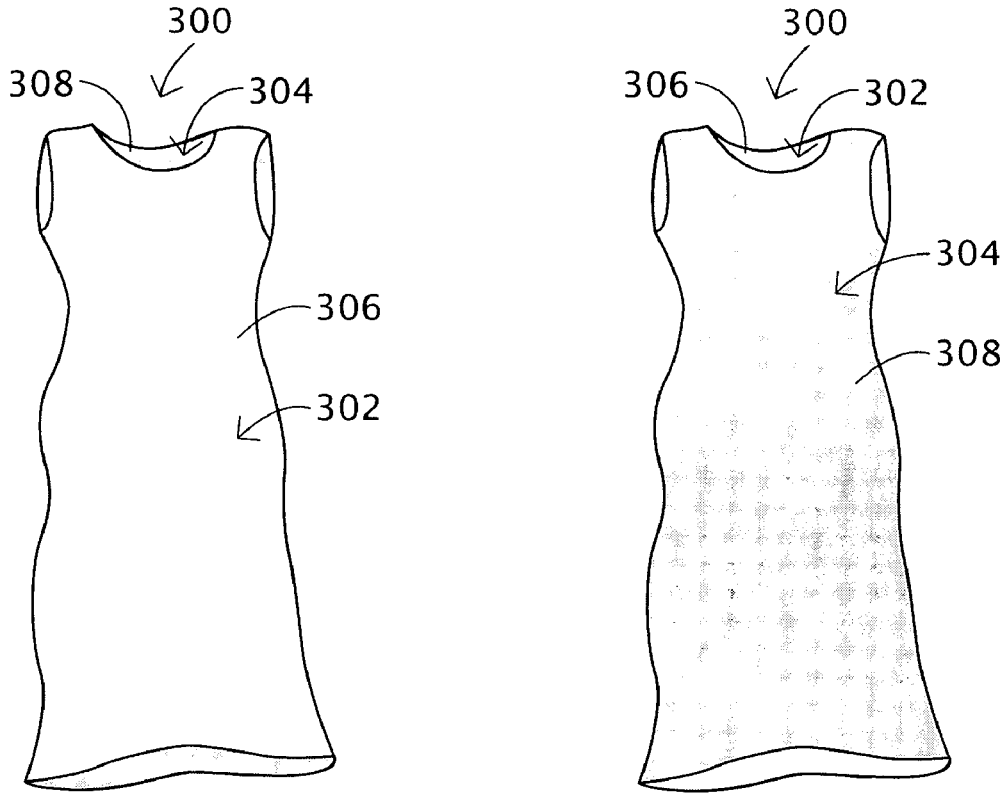
FIG. 5 shows an additional embodiment of the textile article of the present invention.

FIG. 5 shows an additional embodiment of the textile article of the present invention. In this embodiment, the textile article is a dress 300. The dress 300 has a first face 302 with a first printable portion 306, and a second face 304 with a second printable portion 308. The first printable portion of the dress 306 has been printed with a light ink. The second printable portion of the shorts 308 has been printed with a dark ink.

Figure 6:
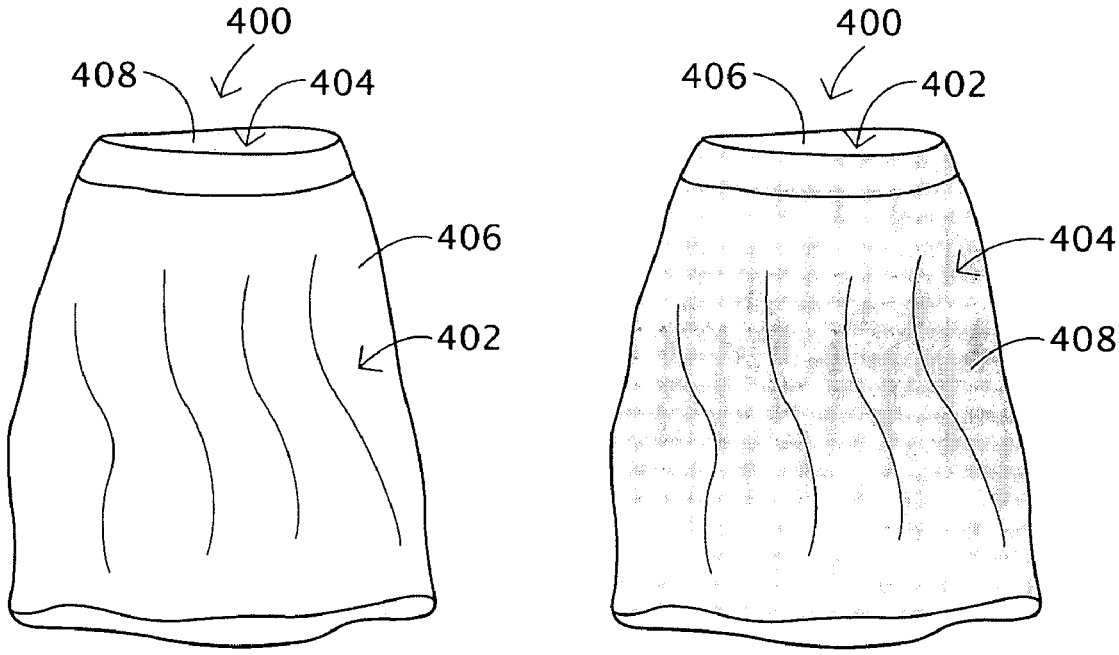
FIG. 6 shows an additional embodiment of the textile article of the present invention.

FIG. 6 shows an additional embodiment of the textile article of the present invention. In this embodiment, the textile article is a skirt or kilt 400. The skirt 400 has a first face 402 with a first printable portion 406, and a second face 404 with a second printable portion 408. The first printable portion of the skirt 406 has been printed with a light ink. The second printable portion of the skirt 408 has been printed with a dark ink.

Figure 7:
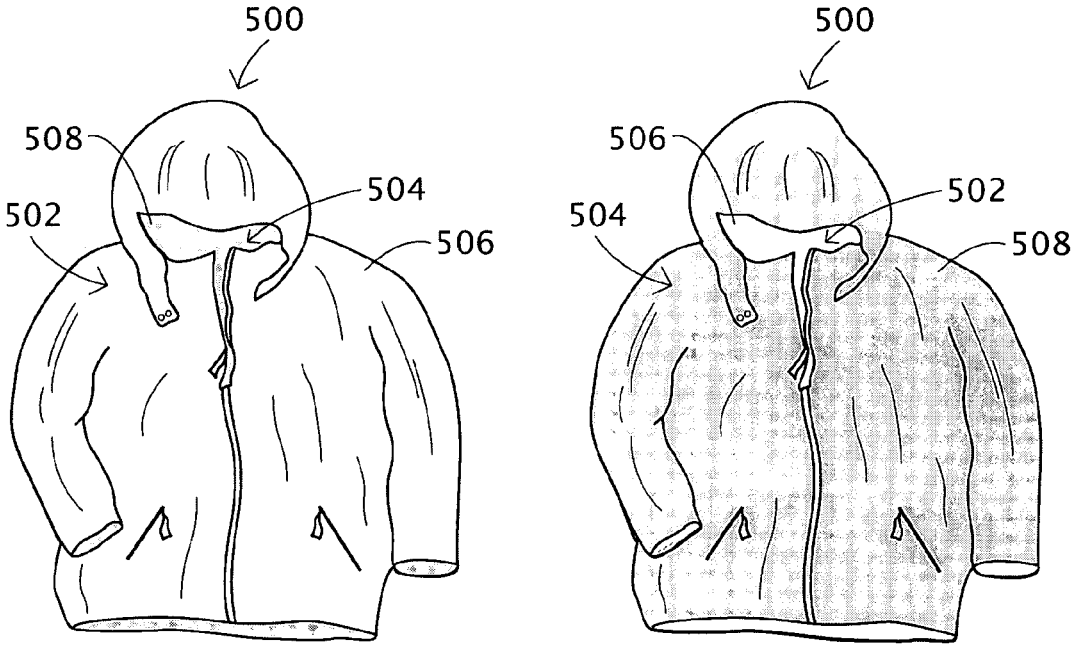
FIG. 7 shows an additional embodiment of the textile article of the present invention.

FIG. 7 shows an additional embodiment of the textile article of the present invention. In this embodiment, the textile article is a jacket or coat 500. Those skilled in the art would recognize that the description would also apply to a vest, which is similar to a jacket but with shorter sleeves. The jacket 500 has a first face 502 with a first printable portion 506, and a second face 504 with a second printable portion 508. The first printable portion of the jacket 506 has been printed with a light ink. The second printable portion of the jacket 508 has been printed with a dark ink.

Figure 8:
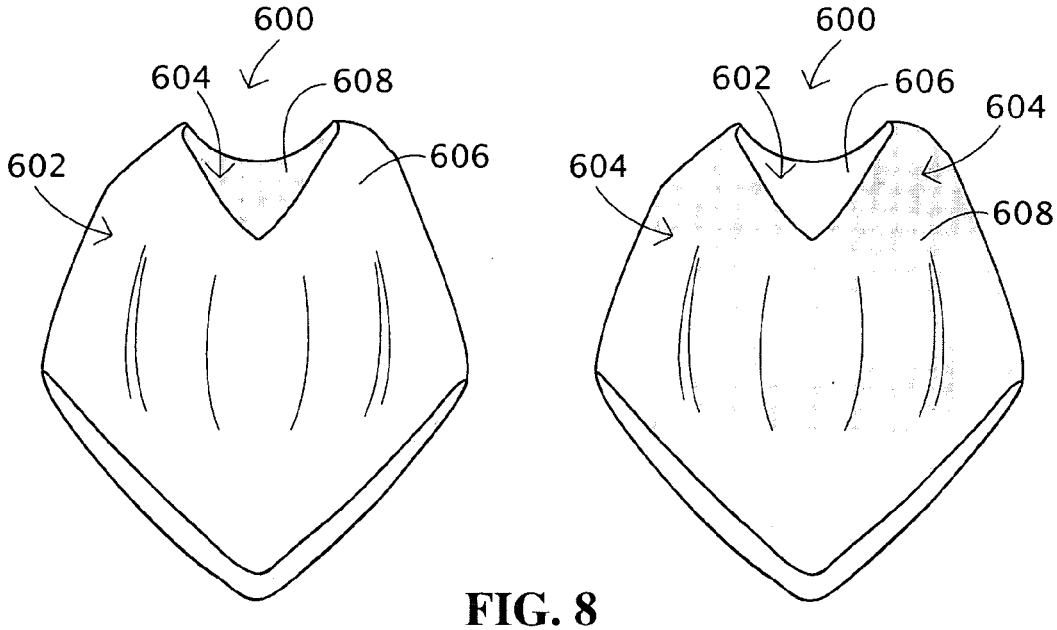
FIG. 8 shows an additional embodiment of the textile article of the present invention.

FIG. 8 shows an additional embodiment of the textile article of the present invention. In this embodiment, the textile article is a poncho 600. The poncho 600 has a first face 602 with a first printable portion 606, and a second face 604 with a second printable portion 608. The first printable portion of the poncho 606 has been printed with a light ink. The second printable portion of the poncho 608 has been printed with a dark ink. The displayed embodiments are illustrative only, and other textile articles, such as, other dresses, jackets, shirts, coats, shorts, pants, etc. are all considered to be within the scope of the present invention.

Those skilled in the art would recognize that a variety printing patterns, colors or texts could be printed on the various embodiments of the present invention either before or after assembly of the article. Similarly, a variety of printing techniques could be used to print on the various embodiments either before or after assembly, all of which are in the scope of the present invention. Preferably, printing is performed using a stamping sublimination transfer print prior to assembly of the article.

Figure 9:
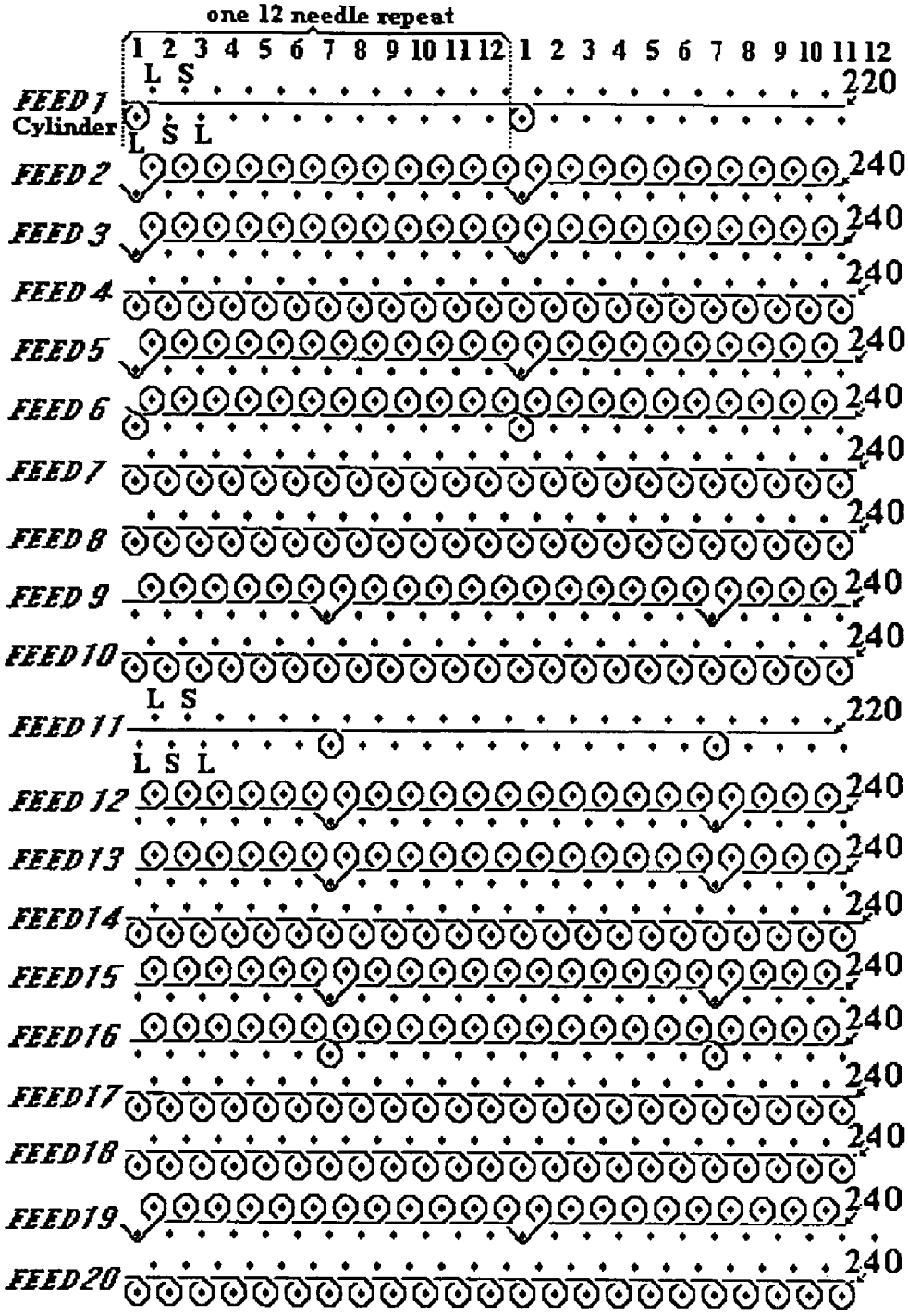
FIG. 9 shows a schematic diagram representing one embodiment of the knitting process of the present invention.

FIG. 9 shows a schematic diagram representing one embodiment of the knitting process for knitting the double face, weft-knit fabric of the present invention. In this embodiment, the first and second faces of the fabric have a substantially identical structure. Particularly, both sides of the fabric have a printable portion capable of being printed. Further, the first and second sides of the fabric may have a substantially similar stitch structure or stitch density, or both.

FIG. 9 represents knitting one embodiment of the invention using a double knit machine. The most preferred machine for achieving the present invention is a circular machine having a cylinder needle bed and a dial needle bed, such as a MONARCH FIL8-AL, available from The Monarch Knitting Machinery Corporation of Monroe, N.C., with a 30" diameter having 24 needle/inch and 84 feeds, with only 80 feeds used. Those skilled in the art will recognize that a double needle bed weft-knitting machine of a flat bed configuration might also be used to produce the present invention, and fabrics made on such a machine, or other similar machines, are considered to be within the scope of the invention.

FIG. 9 describes a 20 feed knitting sequence repeating on 12 needles, each feed knitting one course, creating a pattern repeat for forming a fabric according to the present invention. The needles of the knitting machine are arranged in a standard offset or rib gating, meaning that each of the two needle beds includes a plurality of needles. The needles and their respective needle beds are offset relative to each other, allowing adjacent needles from the individual beds to be in motion at the same time. Cylinder needles are the vertical moving needles of one bed. Dial needles are the horizontal moving needles of the other bed.

Feed 1 forms the first course of the 20 feed knitting sequence using first yarn 220 as it is fed to the knitting elements between the dial and cylinder needle beds only to knit on every $1^{st}$ long needle of the 12 needle repeat of the cylinder bed, while missing all long and short cylinder needles of the dial as well as missing 11 long and short cylinder needles within the 12 needle repeat. In this embodiment, the first yarn 220 is substantially transparent and relatively fine denier synthetic continuous monofilament polyester yarn, in a denier range of between about 15 and 30 denier. The most preferred embodiment uses a 20 denier clear or semi-dull luster in a round cross-section. Such a yarn is ideal for maximizing the ability to visually see through the fabric in selected locations, such as openings. Still others may prefer to use other natural or synthetic yarns, all of which would be within the scope of the present invention.

Feeds 2 and 3 are identical to each other and form the second and third courses of the knitting sequence using second yarn 240 as it is fed to the knitting elements essentially knitting on all long and short needles of the dial bed while tucking on the very same long needles of the cylinder, or on every $1^{st}$ long needle of the 12 needle repeat that the previous feed 1 knitted to, and missing 11 long and short cylinder needles within the 12 needle repeat. In this embodiment, the second yarn 240 is preferably a substantially opaque heavier denier textured synthetic continuous multifilament polyester yarn in a range between 100 and 200 denier. More preferably the second yarn 240 is a 150 denier semi-dull round cross-section with a relatively high number of filaments in the yarn bundle in a range of between 68 and 216 filaments, preferably 100 to 136 filaments. This yarn is preferable for its increased ability to create high density fabric quality with a closed or tight fabric face so as to serve as a blocker to color transfer through the fabric to the reverse face surface when the fabric is sublimation printed. The higher filament count also increases the wicking properties of the fabric. Preferably, the fabric knitted using the described yarns will have a density of about at least 5 oz. per square yard. Others however may use other yarns, such as spandex, nylon, viscose, cotton or blends to achieve the present invention, all of which would be in the scope of the present invention.

Feed 4 forms the fourth course in the 20 feed knitting sequence using second yarn 240 and knits on all long and short needles of the cylinder while missing all long and short needles of the dial altogether.

Feed 5 forms the fifth course of the 20 feed knitting sequence using second yarn 240, as it is fed to the knitting elements essentially knitting on all long and short needles of the dial bed while tucking on the very same long needles of the cylinder, or on every $1^{st}$ needle that the previous feeds 2 and 3 tucked to, and missing 11 long and short cylinder needles within the 12 needle repeat, and is identical to feeds 2 and 3.

Feed 6 forms the sixth course of the 20 feed knitting sequence using second yarn 240, as it is fed to the knitting elements essentially knitting on all long and short needles of the dial bed while knitting on the very same long needles of the cylinder, or on every $1^{st}$ needle that the previous feeds 2, 3 and 5 tucked to, and missing 11 long and short cylinder needles within the 12 needle repeat.

Feed 7 forms the seventh course in the 20 feed knitting sequence using second yarn 240 and knits on all long and short needles of the cylinder while missing all long and short needles of the dial altogether and is identical to feed 4.

Feed 8 forms the eighth course in the 20 feed knitting sequence using second yarn 240 and knits on all long and short needles of the cylinder while missing all long and short needles of the dial altogether and in the same manner is identical to feeds 4 and 7.

Feed 9 forms the ninth course of the 20 feed knitting sequence using second yarn 240 and just like feeds 2, 3 and 5, is fed to the knitting elements essentially knitting on all long and short needles of the dial bed while tucking on only every $7^{th}$ long needle of the cylinder in every 12 needle repeat, and compared to feeds 2, 3 and 5, is off-set by six needles, or exactly half way off-set in relation to the every $1^{st}$ long needle that the previous feeds 2, 3 and 5 tucked to, and missing 11 long and short cylinder needles within the 12 needle repeat. This feed 9 of the 20 feed knitting sequence begins the formation of an opening that is off-setting the placement of the hole exactly centered in between the mesh openings that are formed by the previous feeds 1, 2, 3, 5 and 6. FIG. 1 and FIG. 2 show blow-ups 40 of the fabric in an article of the present invention. Openings 44 in the fabric facilitate breathing.

The openings 44 are shown as substantially circular and are oriented in a staggered symmetrical opening placement; however, virtually any shaped opening and any opening orientation would be within the scope of the present invention. For example, the opening may be round, square, rectangular, hexagonal, tear drop or pointelle. Similarly, other opening orientations with openings placed apart from each other, or horizontally and vertically spaced apart from one another, or equally spaced in the horizontal direction and substantially equally spaced in the vertical direction at a different spacing, or diamond patterned motifs are all within the scope of the present invention. While the above mentioned shapes and orientations are primarily substantially symmetrical, others of skill in the art may desire to knit openings with other symmetrical or non symmetrical shapes or orientations, all of which would also be within the scope of the present invention.

The openings 44 are preferably knitted to be greater than about ½ mm at their diameter or widest point. More preferably, the openings 44 are knitted to be between about ½ mm and 3 mm at their radius or widest point. Most preferably, the openings are knitted to be between about ⅔ mm and 1½ mm at their radius or widest point. Further, the openings do not have to be true openings, that is, they may contain yarn, e.g. the first or second yarn, within the opening to facilitate the knit, or to help shape the opening. Preferably, if a yarn is within the opening, it is a yarn such as the first yarn, as described in the present embodiment, which is difficult to see. Such a construction allows for a weft knit fabric construction that has many similar functional properties as more expensive fabrics, e.g. warp knits, yet can be produced, because of differences in structure, at a lighter weight or lower cost.

Feed 10 forms the tenth course in the 20 feed knitting sequence using second yarn 240 and knits on all long and short needles of the cylinder while missing all long and short needles of the dial altogether and in the same manner is identical to feeds 4, 7 and 8.

Feed 11 forms the eleventh course of the 20 feed knitting sequence using first yarn 220 as it is fed to the knitting elements between the dial and cylinder needle beds only to knit on every 7th long needle within the 12 needle repeat of the cylinder needle bed, while missing all long and short cylinder needles of the dial as well as missing 11 long and short cylinder needles within the 12 needle repeat placing the first yarn 220 into the mesh opening in the now re-positioned offset hole. This feed is similar to feed 1 with the main difference being that the cylinder needle knitted to is exactly 6 needles offset from feed 1, thereby offsetting the opening.

Feed 12 forms the twelfth course of the 20 feed knitting sequence using second yarn 240 and is identical to feed 9. Feed 12 is fed to the knitting elements essentially knitting on all long and short needles of the dial bed while tucking on only every $7^{th}$ long needle of the cylinder in every 12 needle repeat, and compares to feeds 2, 3 and 5, but just like feed 9 it is off-set by six needles, or exactly half way off-set in relation to every $1^{st}$ needle that the previous feeds 2, 3 and 5 tucked to, and missing 11 long and short cylinder needles within the 12 needle repeat.

Feed 13 forms the thirteenth course of the 20 feed knitting sequence using second yarn 240 and is identical to feed 12, and is fed to the knitting elements essentially knitting on all long and short needles of the dial bed while tucking on only every 7th long needle of the cylinder in every 12 needle repeat.

Feed 14 forms the fourteenth course in the 20 feed knitting sequence using second yarn 240 and knits on all long and short needles of the cylinder while missing all long and short needles of the dial altogether and in the same manner is identical to feeds 4, 7, 8 and 10.

Feed 15 forms the fifteenth course of the 20 feed knitting sequence using second yarn 240 and is identical to feeds 9, 12, and 13, and is fed to the knitting elements essentially knitting on all long and short needles of the dial bed while tucking on only every $7^{th}$ long needle of the cylinder in every 12 needle repeat.

Feed 16 forms the sixteenth course of the 20 feed knitting sequence using second yarn 240 and is identical to feed 6, except it is offset by 6 needles in the 12 needle repeat. Second yarn 240 is fed to the knitting elements essentially knitting on all long and short needles of the dial bed while knitting on only every $7^{th}$ long needle of the cylinder within every 12 needle repeat, and compares to feed 6, but just like feeds 11, 12, 13 and 15 it is off-set by six needles compared to feed 6, or exactly half way off-set in relation to the every $1^{st}$ needle that the previous feed 6 knitted to, and missing 11 long and short cylinder needles within the 12 needle repeat.

Feed 17 forms the seventeenth course in the 20 feed knitting sequence using second yarn 240 and knits on all long and short needles of the cylinder while missing all long and short needles of the dial altogether and in the same manner is identical to feeds 4, 7, 8, 10 and 14.

Feed 18 forms the eighteenth course in the 20 feed knitting sequence using second yarn 240 is identical to feed 17, and knits on all long and short needles of the cylinder while missing all long and short needles of the dial altogether and in the same manner is identical to feeds 4, 7, 8, 10, 14 and 17. Feed 19 forms the nineteenth course of the 20 feed knitting sequence using yarn 240, as it is fed to the knitting elements essentially knitting on all long and short needles of the dial bed while tucking on the very same long needles of the cylinder, or on every $1^{st}$ needle that the previous feeds 2, 3 and 5 tucked to, and missing 11 long and short cylinder needles within the 12 needle repeat, and is identical to feeds 2, 3 and 5. This feed 19 of the 20 feed knitting sequence begins the formation of the mesh opening that is off-setting the placement of the hole exactly centered in between the mesh openings that are formed by the previous feeds 9, 11, 12, 13, 15 and 16, thus producing the spaced symmetrical mesh hole placement that is illustrated in this preferred embodiment of the present invention.

Feed 20 forms the twentieth course in the 20 feed knitting sequence using second yarn 240 and knits on all long and short needles of the cylinder while missing all long and short needles of the dial altogether and in the same manner is identical to feeds 4, 7, 8, 10, 14 17 and 18. This completes the 20 feed knit sequence and the subsequent knitting feeds positioned around the circular machine will repeat starting again with feed 1. It is further understood by one skilled in the art that depending on the diameter of the knitting machine and the number of available feed positions on that machine, an even number of repeats of the 20 feed knitting sequence must be adhered to so as to produce a continuous uninterrupted pattern result. For example 20, 40, 60, 80, 100, 120 or 140 available feeds will be required to be divisible by the 20 feed repeat evenly.

Figure 10:
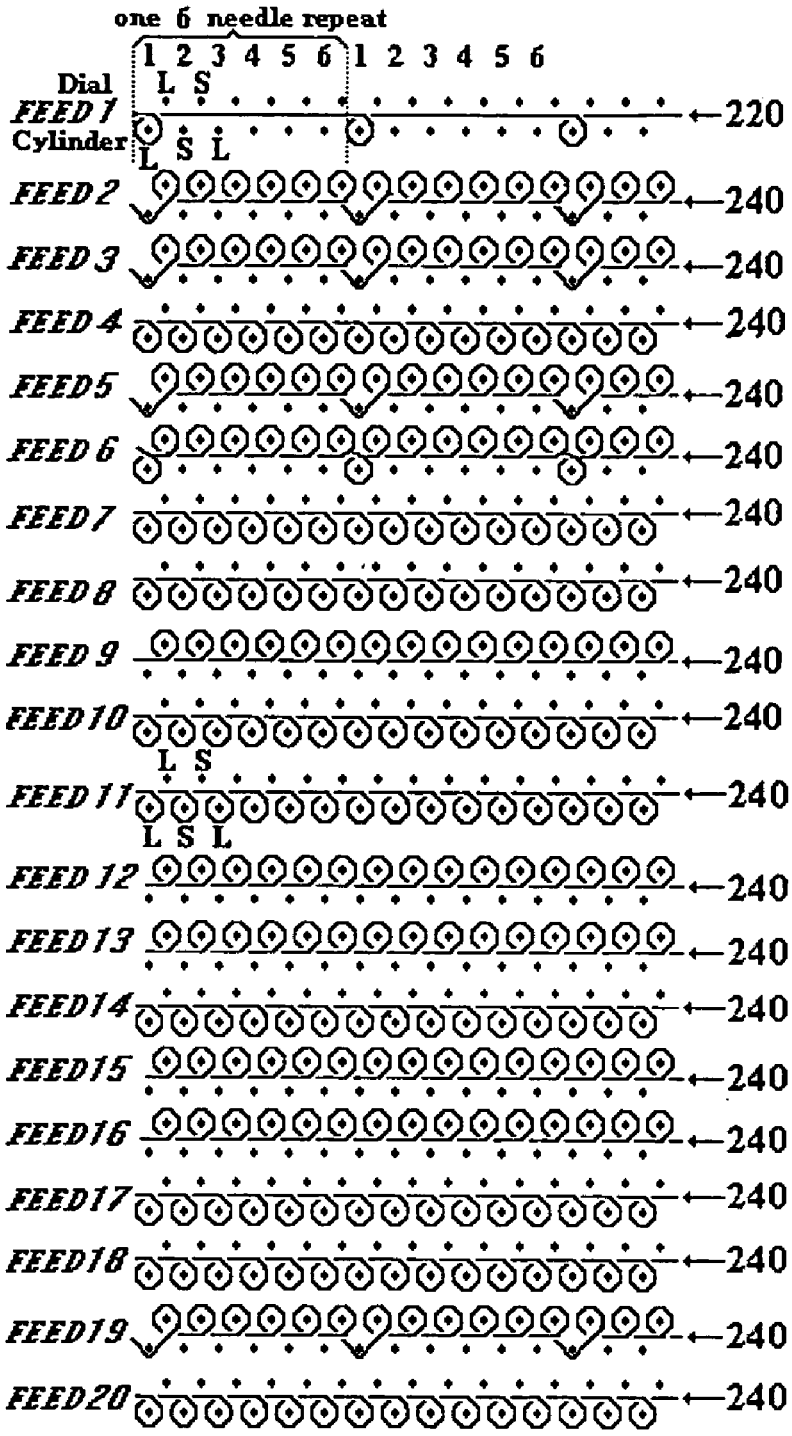
FIG. 10 shows a schematic diagram representing another embodiment of the knitting process of the present invention.

FIG. 10 shows a schematic diagram representing another embodiment of the knitting process of the present invention. The most preferred machine for achieving this embodiment of the present invention is a circular machine having a cylinder needle bed and a dial needle bed, such as a MONARCH FIL8-AL. The preferred machine has a 30" diameter with 24 needle/inch and 84 feeds. Only 80 of the 84 feeds were used. As with the embodiment of FIG. 9, those skilled in the art will recognize that a double needle bed weft-knitting machine of a flat bed configuration might also be used to produce the present invention, and fabrics made on such a machine, or other similar machines, are considered to be within the scope of the invention.

FIG. 10 illustrates an alternate embodiment of the present invention described in FIG. 9. A fabric produced according to FIG. 10 will have openings in a box-like or square motif configuration, essentially spacing the openings apart and essentially in equal distance from each other in both the vertical and horizontal directions. FIG. 10 describes a 20 feed knitting sequence repeating on 6 needles, each feed knitting one course, creating a pattern repeat for forming a fabric according to the present invention. The needles of the knitting machine are arranged in a standard offset or rib gating, similar to FIG. 9.

Feed 1 forms the first course of the 20 feed knitting sequence using first yarn 220 as it is fed to the knitting elements between the dial and cylinder needle beds only to knit on every $1^{st}$ long needle of the 6 needle repeat on the cylinder bed, while missing all long and short cylinder needles of the dial as well as missing 5 long and short cylinder needles within the 6 needle repeat. The first yarn 220 is described as a substantially transparent and relatively fine denier synthetic continuous monofilament polyester yarn. Preferably, the first yarn has a clear or semi-dull luster in a round cross-section, in denier range of between 15 and 30 denier. More preferably, the first yarn 220 is a 20 denier yarn, which maximizes opening structure and visibility through the opening. Others may prefer other yarns, which are within the scope of the present invention.

Feeds 2 and 3 are identical to each other and form the second and third courses of the knitting sequence using second yarn 240. Second yarn 240 is fed to the knitting elements essentially knitting on all long and short needles of the dial bed while tucking on the very same long needles of the cylinder, or on every $1^{st}$ long needle of the 6 needle repeat that the previous feed 1 knitted to, and missing 5 long and short cylinder needles within the 6 needle repeat. The second yarn 240 is described as a substantially opaque heavier denier textured synthetic continuous multifilament polyester yarn in a range between 100 and 200 denier such as 150 denier semi-dull round cross-section with a relatively high number of filaments in the yarn bundle in a range of between 68 and 216 filaments, preferably 100 to 136 filaments, and chosen for reasons of creating a high density fabric quality with a closed or tight fabric face so as to serve as a blocker to color transfer through the fabric to the reverse face surface when the fabric is sublimation printed. The higher filament count also increases the wick ability of perspiration to be transported away from the body skin surface of the wearer of a garment comprised of the present invention, and moves the moisture to the outer surface of the garment. Still, others may prefer other deniers or other filament counts, which would be within the scope of the present invention.

Feed 4 forms the fourth course in the 20 feed knitting sequence using second yarn 240 and knits on all long and short needles of the cylinder while missing all long and short needles of the dial altogether.

Feed 5 forms the fifth course of the 20 feed knitting sequence using second yarn 240, as it is fed to the knitting elements essentially knitting on all long and short needles of the dial bed while tucking on the very same long needles of the cylinder, or on every $1^{st}$ long needle of the 6 needle repeat that the previous feeds 2 and 3 tucked to, and missing 5 long and short cylinder needles within the 6 needle repeat, and is identical to feeds 2 and 3.

Feed 6 forms the sixth course of the 20 feed knitting sequence using second yarn 240, as it is fed to the knitting elements essentially knitting on all long and short needles of the dial bed while knitting on the very same long needles of the cylinder, or on every $1^{st}$ long needle of the 6 needle repeat that the previous feeds 2, 3 and 5 tucked to, and missing 5 long and short cylinder needles within the 6 needle repeat.

Feed 7 forms the seventh course in the 20 feed knitting sequence using second yarn 240 and knits on all long and short needles of the cylinder while missing all long and short needles of the dial altogether and is identical to feed 4.

Feed 8 forms the eighth course in the 20 feed knitting sequence using second yarn 240 and knits on all long and short needles of the cylinder while missing all long and short needles of the dial altogether and in the same manner is identical to feeds 4 and 7.

Feed 9 forms the ninth course of the 20 feed knitting sequence using second yarn 240 and is fed to the knitting elements essentially knitting on all long and short needles of the dial bed, while missing all long and short needles of the cylinder.

Feed 10 forms the tenth course in the 20 feed knitting sequence using second yarn 240 and knits on all long and short needles of the cylinder while missing all long and short needles of the dial altogether and in the same manner is identical to feeds 4, 7 and 8.

Feed 11 forms the eleventh course in the 20 feed knitting sequence using second yarn 240 and knits on all long and short needles of the cylinder while missing all long and short needles of the dial altogether and in the same manner is identical to feeds 4, 7, 8 and 10.

Feed 12 forms the twelfth course of the 20 feed knitting sequence using second yarn 240 and is fed to the knitting elements essentially knitting on all long and short needles of the dial bed, while missing all long and short needles of the cylinder, and is identical to feed 9.

Feed 13 forms the thirteenth course of the 20 feed knitting sequence using second yarn 240 and is identical to feeds 9 and 12, and is fed to the knitting elements essentially knitting on all long and short needles of the dial bed while missing all long and short needles of the cylinder.

Feed 14 forms the fourteenth course in the 20 feed knitting sequence using second yarn 240 and knits on all long and short needles of the cylinder while missing all long and short needles of the dial altogether and in the same manner is identical to feeds 4, 7, 8, 10 and 11.

Feed 15 forms the fifteenth course of the 20 feed knitting sequence using second yarn 240 and is identical to feeds 9, 12 and 13, and is fed to the knitting elements essentially knitting on all long and short needles of the dial bed while missing all long and short needles of the cylinder.

Feed 16 forms the sixteenth course of the 20 feed knitting sequence using second yarn 240 and is identical to feeds 9, 12, 13 and 15, and is fed to the knitting elements essentially knitting on all long and short needles of the dial bed while missing all long and short needles of the cylinder.

Feed 17 forms the seventeenth course in the 20 feed knitting sequence using second yarn 240 and knits on all long and short needles of the cylinder while missing all long and short needles of the dial altogether and in the same manner is identical to feeds 4, 7, 8, 10, 11 and 14.

Feed 18 forms the eighteenth course in the 20 feed knitting sequence using second yarn 240 is identical to feed 17, and knits on all long and short needles of the cylinder while missing all long and short needles of the dial altogether and in the same manner is identical to feeds 4, 7, 8, 10, 11, 14 and 17.

Feed 19 forms the nineteenth course of the 20 feed knitting sequence using second yarn 240, as it is fed to the knitting elements essentially knitting on all long and short needles of the dial bed while tucking on the very same long needles of the cylinder, or on every $1^{st}$ needle within the 6 needle repeat that the previous feeds 2, 3 and 5 tucked to, and missing 5 long and short cylinder needles within the 6 needle repeat, and is identical to feeds 2, 3 and 5. This feed 19 of the 20 feed knitting sequence begins the formation of the mesh opening that is formed by the previous feeds 1, 2, 3, 5 and 6, thus producing the spaced symmetrical mesh hole placement that is illustrated in this alternate embodiment of the present invention.

Feed 20 forms the twentieth course in the 20 feed knitting sequence using second yarn 240 and knits on all long and short needles of the cylinder while missing all long and short needles of the dial altogether and in the same manner is identical to feeds 4, 7, 8, 10, 11 14, 17 and 18. This completes the 20 feed knit sequence and the subsequent knitting feeds positioned around the circular machine will repeat starting again with feed 1.

Figure 11:
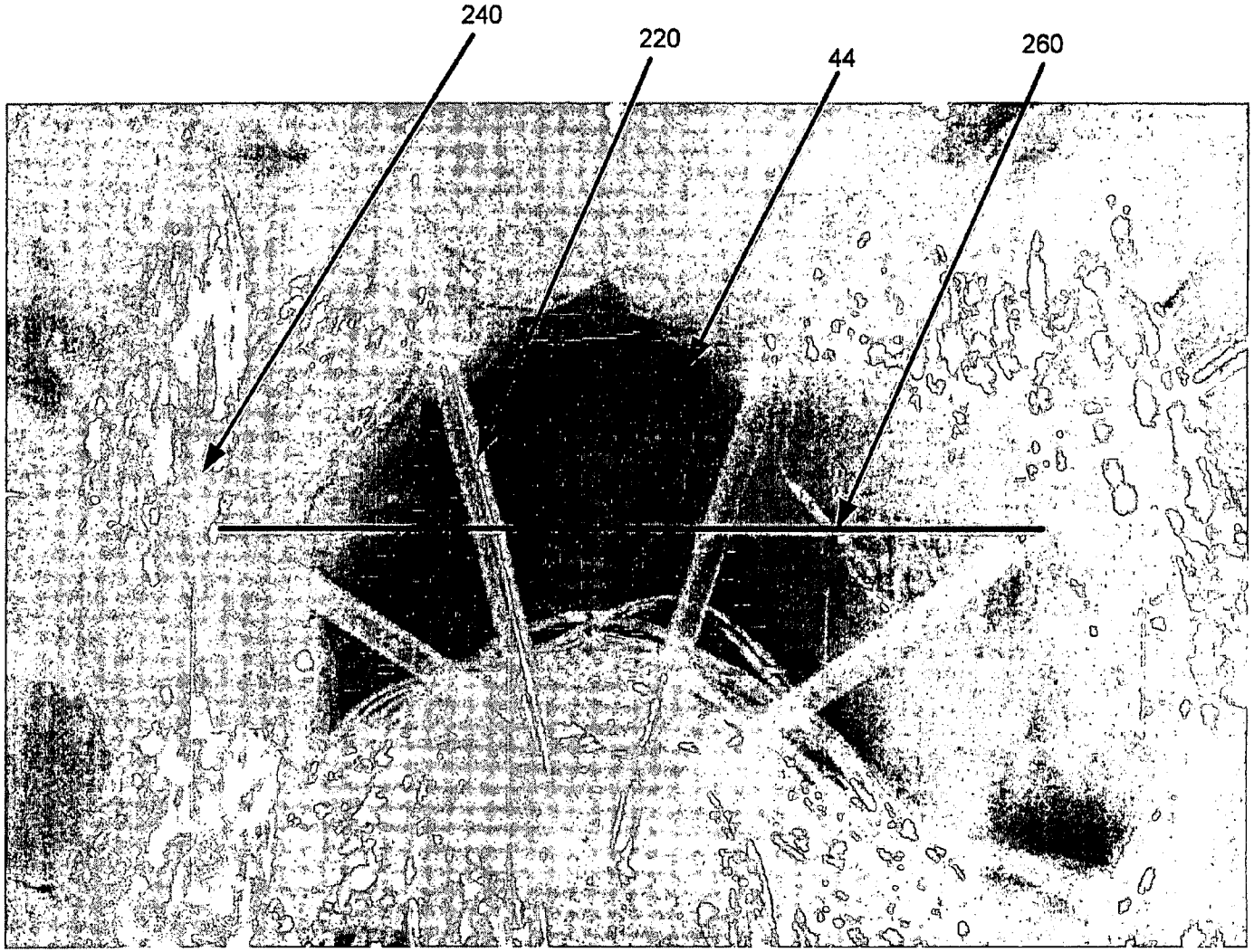
FIG. 11 is a close up photograph of an opening of the fabric knitted according to the schematic of FIG. 9.

FIG. 11 is a close up photograph of an opening of the fabric knitted according to the schematic of FIG. 9. The photograph was taken at 63× magnification. The photograph shows an opening 44 formed by first yarn 220 and second yarn 240. The width 260 of the opening at its widest point, or the widest distance between second yarns, is approximately 1.2 mm. Opening size may be, however, ½ mm, 1 mm, 1.5 mm, 2 mm, 2.5, mm, or 3 mm. As can be seen, the opening may be considered to be defined at its perimeter by second yarn 240. Opening 44 of the fabric includes first yarn 220 or opening-yarn 220, which is weft-knit to, at least in part, facilitate openings. In this embodiment, opening-yarn 220 facilitates opening 44 by maintaining the relative positioning of second yarns (e.g., yarn 240). For example, second yarns may have a tendency to expand beyond the desired length, width, or radius of the desired opening. Using the present invention, opening-yarns can be used to maintain the desired shape and size of openings, for example, creating openings that appear to be of a uniform circular size to the naked eye. As can be seen, a plurality of opening-yarns may actually be positioned within an opening to facilitate the desired size or shape of the opening, e.g., and opening with about a 1 mm diameter or that is 1 mm at its widest point. Some may desire to achieve the present invention with more or less opening yarns, all embodiments of which are considered to be within the scope of the present invention.

While at 63× magnification, the opening-yarn 220 is easily visible, without magnification, e.g., when a garment made of the fabric is worn, the opening yarn becomes very difficult, almost impossible, to see with the naked eye. The present invention makes the fabric appear to have true openings, which in most embodiments appear to be true circular openings resembling openings seen in simplex warp knits. Such a construction allows for a fabric that is more economical to produce, but that still has many of the benefits of more expensive fabrics or fabrics that are more difficult to produce, e.g., the benefits of increased breathability in combination with printability. As seen by FIG. 11, the present invention is also distinct from other fabrics and methods of knitting eyelets, such as pelerine knitting or eyelet knitting, where eyelets are formed by transferring sinker loops to adjacent needles, usually two adjacent needles.

Figure 12:
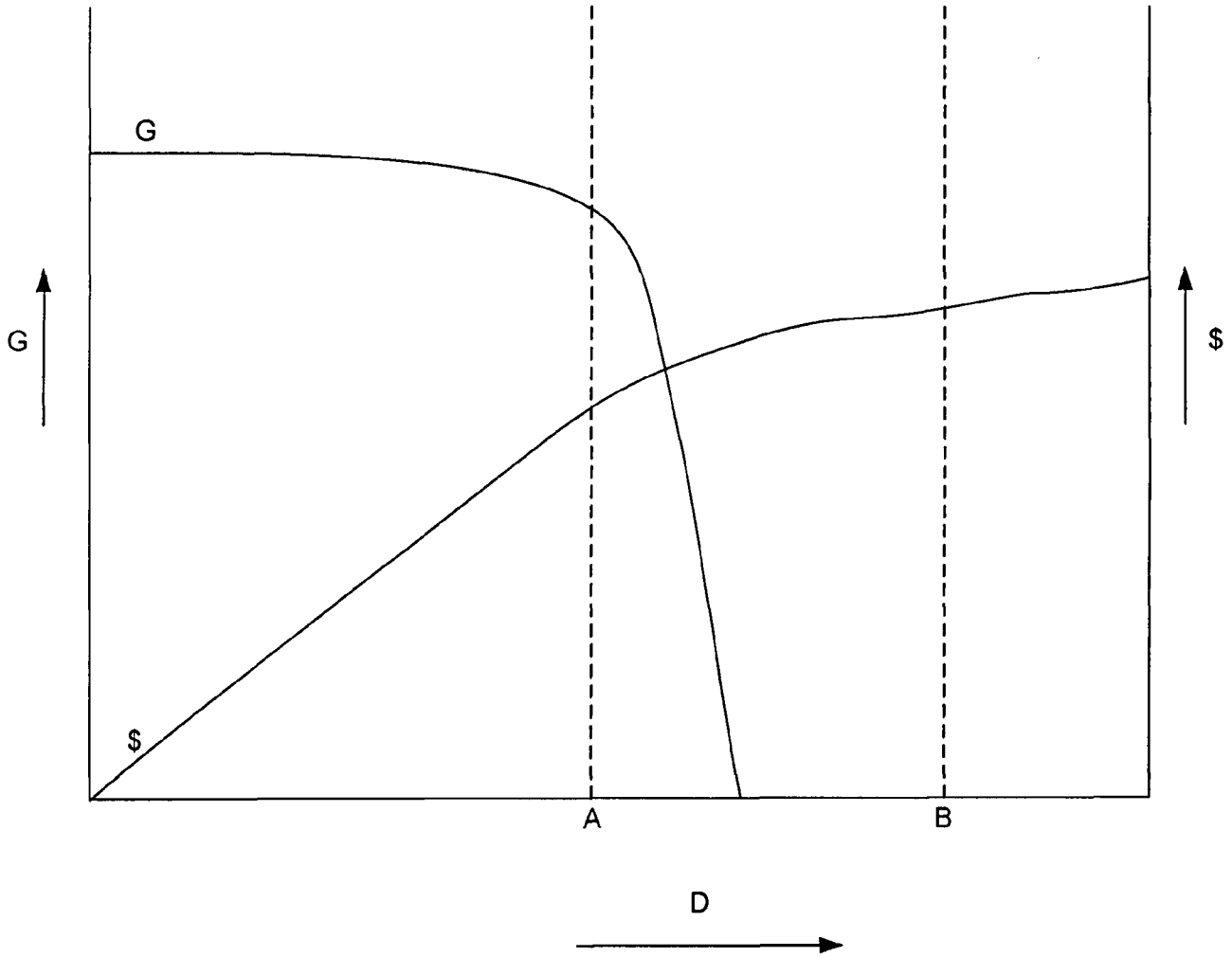

FIG. 12 shows a graphic relationship between fabric density (D), cost ($) and grin-through (G). Generally, as density (D) increases the cost ($) of producing the fabric increases. Grin-through (G) however remains relatively constant with increasing density (D) and then quickly decreases. Point B represents the density (D) where cost ($) becomes prohibitive. Point A represents the point where grin-through (G) decreases rapidly. Preferably the fabric of the present invention has a density approximately in between point A and point B, for example, a density between about 5.0 oz. per square yard and about 7.5 oz. per square yard. Still, the fabric of the present invention may have a density between about 5.5 and 7 oz. per square yard. Preferably, the fabric of the present invention has a density between about 6 and 7 oz. per square yard. Even more preferably, the fabric of the present invention has a density between about 6 and 6.8 oz. per square yard. Even more preferable still, the fabric of the present invention has a density between about 6.2 and 6.7 oz. per square yard. Most preferably, the fabric of the present invention has a density between about 6.3 and 6.6 oz. per square yard.

Figure 13:
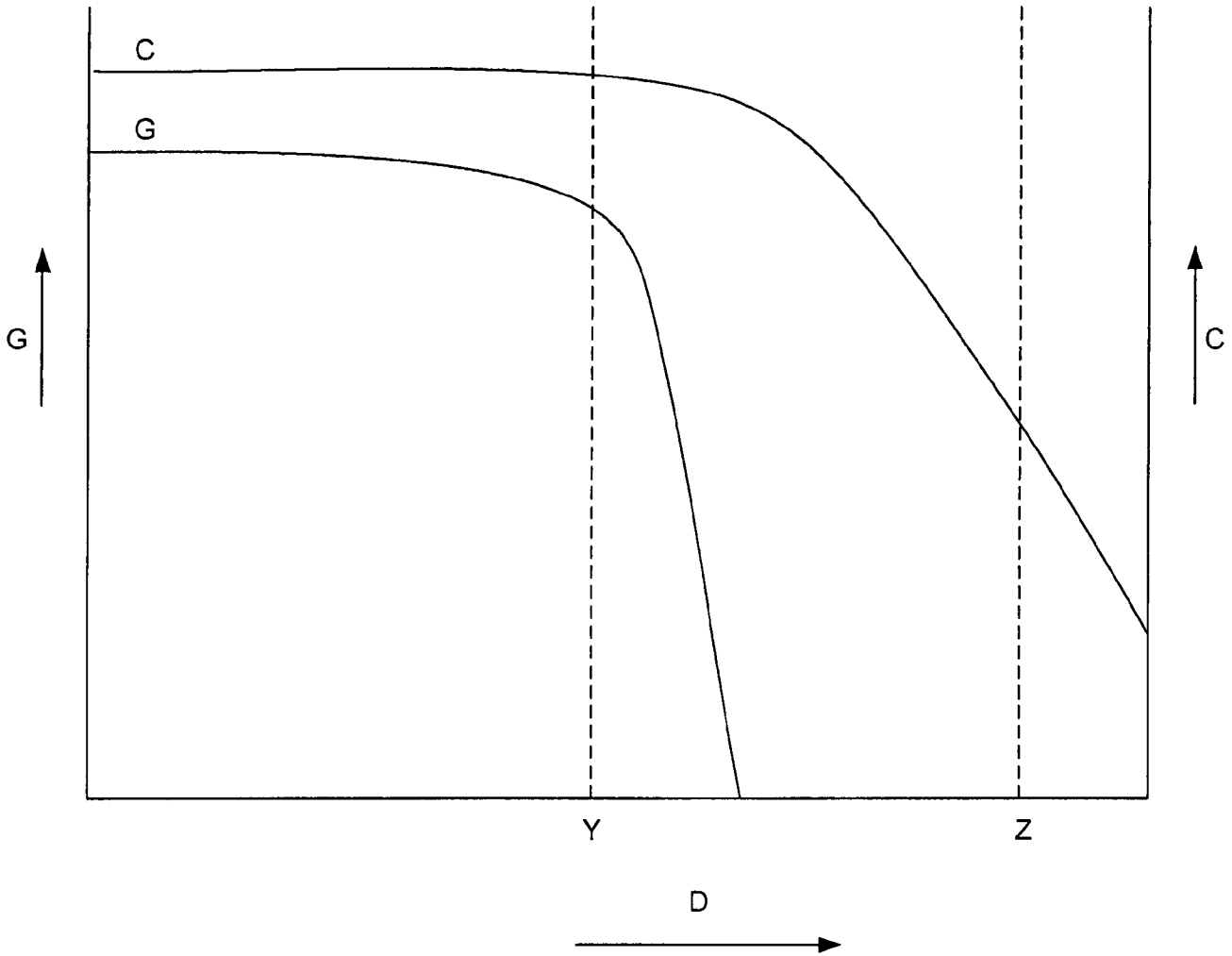

FIG. 13 shows a graphic relationship between fabric density (D), comfort (C) and grin-through (G). Generally, as density (D) increases the comfort (C) of a fabric remains relatively constant and then quickly decreases. Similarly, grin-through (G) remains relatively constant with increasing density (D) and then quickly decreases. Point Y represents the density (D) where grin-through (G) starts its rapid decreases. Point Z represents the point where the decrease in comfort becomes prohibitive. Preferably the fabric of the present invention also has a density approximately in between point Y and point Z, e.g. a density between about 5 and 8 oz. per square yard.

Figure 14:
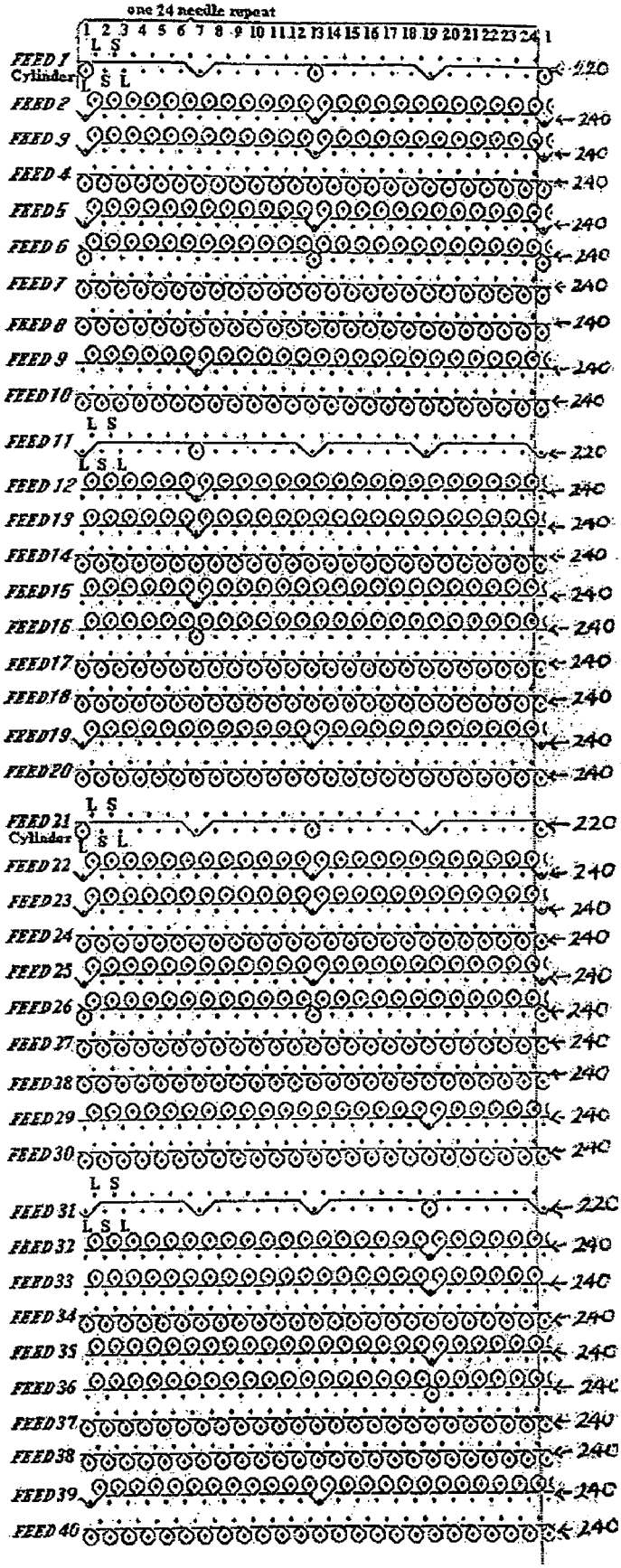
FIG. 14 shows a schematic diagram representing another embodiment of the knitting process of the present invention.

FIG. 14 shows a schematic diagram representing another embodiment of the knitting process of the present invention. FIG. 14 describes a 40 feed knitting sequence repeating on 24 needles, each feed knitting one course, creating a pattern repeat for forming a fabric according to the present invention.

FIG. 14 illustrates an alternate embodiment of the present invention described in FIG. 9. A fabric produced according to FIG. 14 will have openings in a geometric diamond shaped motif, essentially spacing the openings apart, and essentially taking the pattern design of FIG. 9, and closing off 25 percent of the holes, or, more specifically, removing 2 holes out of every 8 holes that occur in the fabric described in FIG. 9. In this way, there is formed a larger offset diamond shaped area of solid fabric without a hole thus providing an increased solid area for printing of both face and back surfaces.

Feed 1 forms the first course of the 40 feed knitting sequence using first yarn 220 as it is fed to the knitting elements between the dial and cylinder needle beds only to knit on every $1^{st}$ and $13^{th}$ needle of the 24 needle repeat on the cylinder bed, only to tuck on every $7^{th}$ and $19^{th}$ needle of the 24 needle repeat on the cylinder bed, while missing all long and short cylinder needles of the dial as well as missing long and short cylinder needles 2 thru 6, 8 thru 12, 14 thru 18, and 20 thru 24 within the 24 needle repeat. In this embodiment, the first yarn 220 is the same substantially transparent and relatively fine denier synthetic continuous monofilament polyester yarn as preferred in FIG. 9, in a denier range of between about 15 and 30 denier. The most preferred embodiment uses a 20 denier clear or semi-dull luster in a round cross-section. Such a yarn is ideal for maximizing the ability to visually see through the fabric in selected locations, such as openings. Still others may prefer to use other natural or synthetic yarns, all of which would be within the scope of the present invention.

Feeds 2 and 3 are identical to each other and form the second and third courses of the 40 feed repeat knitting sequence using second yarn 240 as it is fed to the knitting elements essentially knitting on all long and short needles of the dial bed while tucking on the very same long needles of the cylinder, or on every $1^{st}$ and $13^{th}$ long needle of the 24 needle repeat that the previous feed 1 knitted to, and missing long and short cylinder needles 2 thru 12, and 14 thru 24 within the 24 needle repeat. In this embodiment, the second yarn 240 is preferably a substantially opaque heavier denier textured synthetic continuous multifilament polyester yarn in a range between 100 and 200 denier. More preferably the second yarn 240 is a 150 denier, semi-dull round cross-section with a relatively high number of filaments in the yarn bundle in a range of between 68 and 216 filaments, preferably 96 to 136 filaments. This yarn is preferable for its increased ability to create high density fabric quality with a closed or tight fabric face so as to serve as a blocker to color transfer through the fabric to the reverse face surface when the fabric is sublimation printed. The higher filament count also increases the wicking properties of the fabric. Preferably, the fabric knitted using the described yarns will have a density of about at least 5 oz. per square yard. Others however may use other yarns, such as spandex, nylon, viscose, cotton or blends to achieve the present invention, all of which would be in the scope of the present invention.

Feed 4 forms the fourth course in the 40 feed knitting sequence using second yarn 240 and knits on all long and short needles of the cylinder while missing all long and short needles of the dial altogether.

Feed 5 forms the fifth course of the 40 feed knitting sequence using second yarn 240, as it is fed to the knitting elements essentially knitting on all long and short needles of the dial bed while tucking on the very same long needles of the cylinder, or on every $1^{st}$ and $13^{th}$ needle that the previous feeds 2 and 3 tucked to, missing long and short cylinder needles 2 thru 12, and 14 thru 24 within the 24 needle repeat, and is essentially identical to feeds 2 and 3.

Feed 6 forms the sixth course of the 40 feed knitting sequence using second yarn 240, as it is fed to the knitting elements essentially knitting on all long and short needles of the dial bed while knitting on the very same long needles of the cylinder, or on every $1^{st}$ and $13^{th}$ needle that the previous feeds 2, 3 and 5 tucked to, and missing long and short cylinder needles 2 thru 12, and 14 thru 24 within the 24 needle repeat.

Feed 7 forms the seventh course in the 40 feed knitting sequence using second yarn 240 and knits on all long and short needles of the cylinder while missing all long and short needles of the dial altogether and is identical to feed 4.

Feed 8 forms the eighth course in the 40 feed knitting sequence using second yarn 240 and knits on all long and short needles of the cylinder while missing all long and short needles of the dial altogether and in the same manner is identical to feeds 4 and 7.

Feed 9 forms the ninth course of the 40 feed knitting sequence using second yarn 240 and just like feeds 2, 3 and 5, is fed to the knitting elements essentially knitting on all long and short needles of the dial bed while tucking on only every $7^{th}$ long needle of the cylinder in every 24 needle repeat, and compared to feeds 2, 3 and 5, is off-set by six needles, or exactly half way off-set in relation to the every $1^{st}$ long needle that the previous feeds 2, 3 and 5 tucked to, and missing 23 long and short cylinder needles within the 24 needle repeat. This feed 9 of the 40 feed knitting sequence begins the formation of an opening that is off-setting the placement of the hole exactly centered in between the mesh openings that are formed by the previous feeds 1, 2, 3, 5 and 6. This feed 9 also begins the area to be knitted facilitating a wider 23 needle distance between mesh openings that is accomplished using feeds 9 thru 16.

Feed 10 forms the tenth course in the 40 feed knitting sequence using second yarn 240 and knits on all long and short needles of the cylinder while missing all long and short needles of the dial altogether and in the same manner is identical to feeds 4, 7 and 8.

Feed 11 forms the eleventh course of the 40 feed knitting sequence using first yarn 220 as it is fed to the knitting elements between the dial and cylinder needle beds only to knit on every $7^{th}$ needle of the 24 needle repeat on the cylinder bed, and only to tuck on every $1^{st}$, $13^{th}$ and $19^{th}$ needle of the 24 needle repeat on the cylinder bed, while missing all long and short cylinder needles of the dial as well as missing long and short cylinder needles 2 thru 6, 8 thru 12, 14 thru 18, and 20 thru 24 within the 24 needle repeat placing the first yarn 220 into the mesh opening in the now re-positioned offset hole. This feed is similar to feed 1 with the main difference being the cylinder needle knitted to is exactly 6 needles offset from feed 1, thereby offsetting the opening to the $7^{th}$ needle, and there is no other opening created through the next 23 needles in the repeat which results in a removal of one hole opening thus effectively forming a wider solid diamond shaped fabric area with feeds 11 through 20 in the rightmost portion of the 24 needle repeat of the design.

Feed 12 forms the twelfth course of the 40 feed knitting sequence using second yarn 240 and is identical to feed 9. Feed 12 is fed to the knitting elements essentially knitting on all long and short needles of the dial bed while tucking on only every $7^{th}$ long needle of the cylinder in every 24 needle repeat.

Feed 13 forms the thirteenth course of the 40 feed knitting sequence using second yarn 240 and is identical to feed 12, and is fed to the knitting elements essentially knitting on all long and short needles of the dial bed while tucking on only every 7th long needle of the cylinder in every 24 needle repeat.

Feed 14 forms the fourteenth course in the 40 feed knitting sequence using second yarn 240 and knits on all long and short needles of the cylinder while missing all long and short needles of the dial altogether and in the same manner is identical to feeds 4, 7, 8 and 10.

Feed 15 forms the fifteenth course of the 40 feed knitting sequence using second yarn 240 and is identical to feeds 9, 12 and 13, and is fed to the knitting elements essentially knitting on all long and short needles of the dial bed while tucking on only every $7^{th}$ long needle of the cylinder in every 24 needle repeat.

Feed 16 forms the sixteenth course of the 40 feed knitting sequence using second yarn 240 and is identical to feed 6, except it is offset by 6 needles. Second yarn 240 is fed to the knitting elements essentially knitting on all long and short needles of the dial bed while knitting on only every $7^{th}$ long needle of the cylinder within every 24 needle repeat, and compares to feed 6, but just like feeds 11, 12, 13 and 15 it is off-set by six needles compared to feed 6, or exactly half way off-set in relation to the every $1^{st}$ needle that the previous feed 6 knitted to, and missing 23 long and short cylinder needles within the 24 needle repeat, essentially ending and closing the hole opening located on the leftmost side of the 24 needle repeat Feed 17 forms the seventeenth course in the 40 feed knitting sequence using second yarn 240 and knits on all long and short needles of the cylinder while missing all long and short needles of the dial altogether and in the same manner is identical to feeds 4, 7, 8, 10 and 14.

Feed 18 forms the eighteenth course in the 40 feed knitting sequence using second yarn 240 is identical to feed 17, and knits on all long and short needles of the cylinder while missing all long and short needles of the dial altogether and in the same manner is identical to feeds 4, 7, 8, 10, 14 and 17.

Feed 19 forms the nineteenth course of the 40 feed knitting sequence using yarn 240, as it is fed to the knitting elements essentially knitting on all long and short needles of the dial bed while tucking on the very same long needles of the cylinder, or on every $1^{st}$ needle that the previous feeds 2, 3 and 5 tucked to, and missing 11 long and short cylinder needles within the 12 needle repeat, and is identical to feeds 2, 3 and 5. This feed 19 of the 40 feed knitting sequence begins the formation of the mesh openings that are off-setting the placement of the hole exactly centered in between the mesh openings that are formed by the previous feeds 9, 11, 12, 13, 15 and 16, thus producing the same spaced symmetrical mesh hole placement that is illustrated in feeds 1, 2, 3, 5 and 6

Feed 20 forms the twentieth course in the 40 feed knitting sequence using second yarn 240 and knits on all long and short needles of the cylinder while missing all long and short needles of the dial altogether and in the same manner is identical to feeds 4, 7, 8, 10, 14, 17 and 18.

Feed 21 is exactly like feed 1 and forms the twenty-first course of the 40 feed knitting sequence using first yarn 220 as it is fed to the knitting elements between the dial and cylinder needle beds only to knit on every $1^{st}$ and $13^{th}$ needle of the 24 needle repeat on the cylinder bed, only to tuck on every $7^{th}$ and $19^{th}$ needle of the 24 needle repeat on the cylinder bed, while missing all long and short cylinder needles of the dial as well as missing long and short cylinder needles 2 thru 6, 8 thru 12, 14 thru 18, and 20 thru 24 within the 24 needle repeat.

Feeds 22 and 23 are identical to each other and form the twenty-second and twenty-third courses of the 40 feed repeat knitting sequence using second yarn 240 as it is fed to the knitting elements essentially knitting on all long and short needles of the dial bed while tucking on the very same long needles of the cylinder, or on every $1^{st}$ and $13^{th}$ long needle of the 24 needle repeat that the previous feed 21 knitted to, and missing long and short cylinder needles 2 thru 12, and 14 thru 24 within the 24 needle repeat. Feeds 22 and 23 are identical to feeds 2, 3, 5 and 19.

Feed 24 forms the twenty-fourth course in the 40 feed knitting sequence using second yarn 240 and knits on all long and short needles of the cylinder while missing all long and short needles of the dial altogether, and is identical to previous feeds 4, 7, 8, 10, 14, 17, 18 and 20.

Feed 25 forms the twenty-fifth course of the 40 feed knitting sequence using second yarn 240, as it is fed to the knitting elements essentially knitting on all long and short needles of the dial bed while tucking on the very same long needles of the cylinder, or on every $1^{st}$ and $13^{th}$ needle that the previous feeds 22 and 23 tucked to, missing long and short cylinder needles 2 thru 12, and 14 thru 24 within the 24 needle repeat, and is essentially identical to feeds 2, 3, 5, 19, 22 and 23.

Feed 26 is identical to feed 6 and forms the twenty-sixth course of the 40 feed knitting sequence using second yarn 240, as it is fed to the knitting elements essentially knitting on all long and short needles of the dial bed while knitting on the very same long needles of the cylinder, or on every $1^{st}$ and $13^{th}$ needle that the previous feeds 22, 23 and 25 tucked to, and missing long and short cylinder needles 2 thru 12, and 14 thru 24 within the 24 needle repeat.

Feeds 27 and 28 are identical and form the twenty-seventh and twenty-eighth courses in the 40 feed knitting sequence using second yarn 240 and knit on all long and short needles of the cylinder while missing all long and short needles of the dial altogether and are identical to feeds 4, 7, 8, 10, 14, 17, 18, 20 and 24.

Feed 29 forms the twenty-ninth course of the 40 feed knitting sequence using second yarn 240 and just like feed 9, is fed to the knitting elements essentially knitting on all long and short needles of the dial bed while tucking on only every $19^{th}$ long needle of the cylinder in every 24 needle repeat, and compared to feeds 22, 23 and 25, is off-set by six needles, or exactly half way off-set in relation to the every $1^{st}$ and $13^{th}$ long needle that the previous feeds 22, 23 and 25 tucked to, and missing 23 long and short cylinder needles within the 24 needle repeat. This feed 29 of the 40 feed knitting sequence begins the formation of an opening that is off-setting the placement of the hole exactly centered in between the mesh openings that are formed by the previous feeds 21, 22, 23, 25 and 26. This feed 29 also begins the area to be knitted facilitating a wider 23 needle distance between mesh openings that is to accomplished using feeds 29 thru 36, creating a wider diamond shaped solid area in the left-most side of the 24 needle design repeat.

Feed 30 forms the thirtieth course in the 40 feed knitting sequence using second yarn 240 and knit on all long and short needles of the cylinder while missing all long and short needles of the dial altogether and are identical to feeds 4, 7, 8, 10, 14, 17, 18, 20, 24, 27 and 28.

Feed 31 forms the thirty-first course of the 40 feed knitting sequence using first yarn 220 as it is fed to the knitting elements between the dial and cylinder needle beds only to knit on every $19^{th}$ needle of the 24 needle repeat on the cylinder bed, and only to tuck on every $1^{st}$, $7^{th}$ and $13^{th}$ needle of the 24 needle repeat on the cylinder bed, while missing all long and short cylinder needles of the dial as well as missing long and short cylinder needles 2 thru 6, 8 thru 12, 14 thru 18, and 20 thru 24 within the 24 needle repeat placing the first yarn 220 into the mesh opening in the now re-positioned offset hole. This feed is similar to feed 11 with the main difference being the cylinder needle knitted to is exactly 12 needles offset from feed 11, thereby offsetting the opening to the $19^{th}$ needle, and there is no other opening created through the next 23 needles in the repeat which results in a removal of one hole opening thus effectively forming a wider solid diamond shaped fabric area with feeds 31 through 40 in the left-most portion of the 24 needle repeat of the design.

Feed 32 forms the thirty-second course of the 40 feed knitting sequence using second yarn 240 and is identical to feed 29. Feed 32 is fed to the knitting elements essentially knitting on all long and short needles of the dial bed while tucking on only every $19^{th}$ long needle of the cylinder in every 24 needle repeat.

Feed 33 forms the thirty-third course of the 40 feed knitting sequence using second yarn 240 and is identical to feeds 29 and 32, and is fed to the knitting elements essentially knitting on all long and short needles of the dial bed while tucking on only every $19^{th}$ long needle of the cylinder in every 24 needle repeat.

Feed 34 forms the thirty-fourth course in the 40 feed knitting sequence using second yarn 240 and knit on all long and short needles of the cylinder while missing all long and short needles of the dial altogether and are identical to feeds 4, 7, 8, 10, 14, 17, 18, 20, 24, 27, 28 and 30.

Feed 35 forms the thirty-fifth course of the 40 feed knitting sequence using second yarn 240 and is identical to feeds 29, 32 and 33, and is fed to the knitting elements essentially knitting on all long and short needles of the dial bed while tucking on only every $19^{th}$ long needle of the cylinder in every 24 needle repeat.

Feed 36 forms the thirty-sixth course of the 40 feed knitting sequence using second yarn 240 and is identical to feed 16, except it is offset by 12 needles. Second yarn 240 is fed to the knitting elements essentially knitting on all long and short needles of the dial bed while knitting on only every $19^{th}$ long needle of the cylinder within every 24 needle repeat, and compares to feed 16, but just like feeds 11, 12, 13 and 15 it is off-set by 12 needles compared to feed 16, or exactly half way off-set in relation to the every $7^{th}$ cylinder needle that the previous feed 16 knitted to, and missing 23 long and short cylinder needles within the 24 needle repeat, essentially ending and closing the hole opening located on the right-most side of the 24 needle repeat Feeds 37 and 38 form the thirty-seventh and thirty-eighth courses in the 40 feed knitting sequence using second yarn 240 and knit on all long and short needles of the cylinder while missing all long and short needles of the dial altogether and are identical to feeds 4, 7, 8, 10, 14, 17, 18, 20, 24, 27, 28, 30 and 34.

Feed 39 forms the thirty-ninth course of the 40 feed knitting sequence using yarn 240, as it is fed to the knitting elements essentially knitting on all long and short needles of the dial bed while tucking on the very same long needles of the cylinder, or on every $1^{st}$ and $13^{th}$ needle that the previous feeds 22, 23 and 25 tucked to, and missing 11 long and short cylinder needles within the 24 needle repeat, and is identical to feeds 2, 3, 5, 22, 23 and 25. This feed 39 of the 40 feed knitting sequence begins the formation of the mesh openings that are off-setting the placement of the hole exactly centered in between the mesh openings that are formed by the previous feeds 29, 31, 32, 33, 35 and 36, thus producing the same spaced symmetrical mesh hole placement that is illustrated in feeds 1, 2, 3, 5 and 6

Feed 40 forms the fortieth course in the 40 feed knitting sequence using second yarn 240 and knits on all long and short needles of the cylinder while missing all long and short needles of the dial altogether and is identical to feeds 4, 7, 8, 10, 14, 17, 18, 20, 24, 27, 28, 30, 37 and 38.

This completes the 40 feed knit sequence and the subsequent knitting feeds positioned around the circular machine will repeat starting again with feed 1. It is further understood by one skilled in the art that depending on the diameter of the knitting machine and the number of available feed positions on that machine, and if the machine is cam driven, and not Jacquard selected, that an even number of repeats of the 40 feed knitting sequence must be adhered to so as to produce a continuous uninterrupted pattern result. For example 40, 80, 120 or 160 available feeds will be required to be divisible by the 40 feed repeat evenly.

Figure 15:
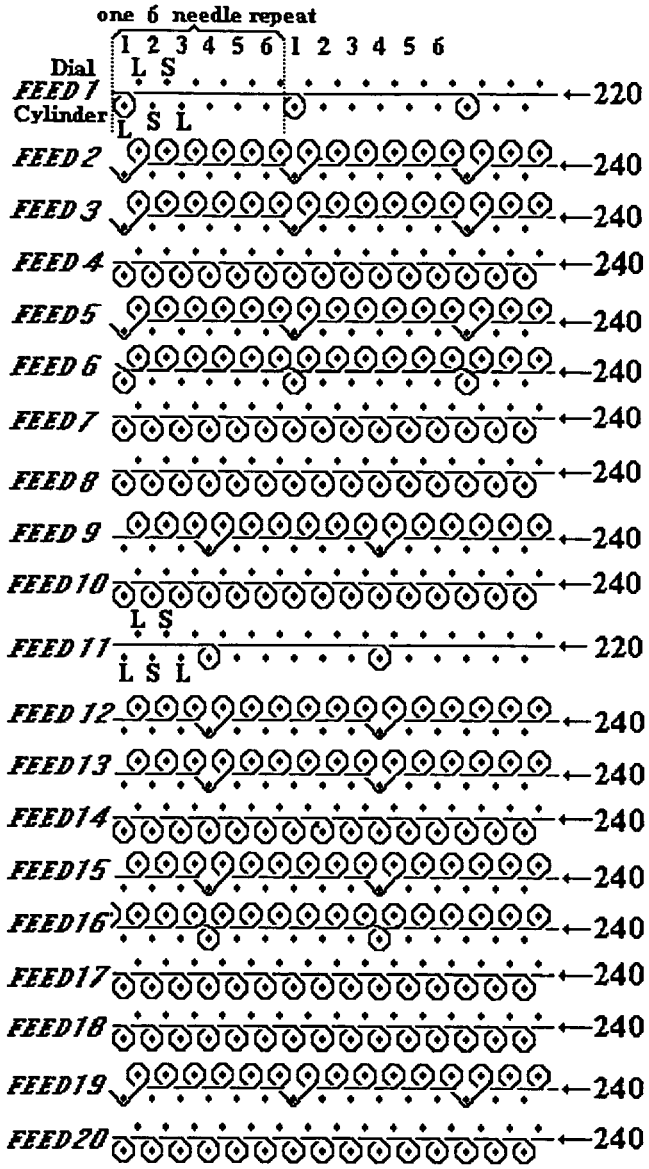
FIG. 15 shows a schematic diagram representing another embodiment of the knitting process of the present invention.

FIG. 15 shows a schematic diagram representing another embodiment of the knitting process of the present invention. FIG. 15 describes a 20 feed knitting sequence repeating on 6 needles, each feed knitting one course, creating a pattern repeat for forming a fabric according to the present invention.

FIG. 15 illustrates an alternate embodiment of the present invention described in FIG. 9. A fabric produced according to FIG. 15 will have openings in a geometric diamond shaped half drop motif, essentially spacing the openings closer together, and essentially taking the pattern design of FIG. 9, and increasing the population percent of the holes, or, more specifically, increasing by 50 to 120 percent more holes than the fabric described in FIG. 9. In this way, there is created a more breathable fabric performance, while still maintaining adequate solid fabric areas on both face and back surfaces with enough density to satisfy printing different colors on both sides without an objectionable grin-thru of one color through the other fabric surface.

Feed 1 forms the first course of the 20 feed knitting sequence using yarn 220 as it is fed to the knitting elements between the dial and cylinder needle beds only to knit on every $1^{st}$ long needle of the 6 needle repeat on the cylinder bed, while missing all long and short cylinder needles of the dial as well as missing 5 long and short cylinder needles within the 6 needle repeat. The yarn 220 is described as a substantially transparent and relatively fine denier synthetic continuous monofilament polyester yarn, such as 20 denier clear or semi-dull luster in a round cross-section, in denier range of between 15 and 30 denier, preferably 20 denier chosen for reasons of maximizing the ability to visually see through the fabric in selected locations according to the fabric construction, thus accentuating a mesh like fabric result, especially when used in combination with a substantially heavier denier yarn possessing opaque properties that comprise the majority percentage of the fabric constituting the solid areas.

Feeds 2 and 3 are identical to each other and form the second and third courses of the knitting sequence using yarn 240 as it is fed to the knitting elements essentially knitting on all long and short needles of the dial bed while tucking on the very same long needles of the cylinder, or on every $1^{st}$ long needle of the 6 needle repeat that the previous feed 1 knitted to, and missing 5 long and short cylinder needles within the 6 needle repeat. The yarn 240 is described as a substantially opaque heavier denier textured synthetic continuous multifilament polyester yarn in a range between 100 and 200 denier such as 150 denier semi-dull round cross-section with a relatively high number of filaments in the yarn bundle in a range of between 68 and 216 filaments, preferably 96 to 136 filaments, and chosen for reasons of creating a high density fabric quality with a closed or tight fabric face so as to serve as a blocker to color transfer through the fabric to the reverse face surface when the fabric is sublimation printed. The higher filament count also increases the wick ability of perspiration to be transported away from the body skin surface of the wearer of a garment comprised of the present invention, and moves the moisture to the outer surface of the garment.

Feed 4 forms the fourth course in the 20 feed knitting sequence using yarn 240 and knits on all long and short needles of the cylinder while missing all long and short needles of the dial altogether.

Feed 5 forms the fifth course of the 20 feed knitting sequence using yarn 240, as it is fed to the knitting elements essentially knitting on all long and short needles of the dial bed while tucking on the very same long needles of the cylinder, or on every $1^{st\ long}$ needle of the 6 needle repeat that the previous feeds 2 and 3 tucked to, and missing 5 long and short cylinder needles within the 6 needle repeat, and is identical to feeds 2 and 3.

Feed 6 forms the sixth course of the 20 feed knitting sequence using yarn 240, as it is fed to the knitting elements essentially knitting on all long and short needles of the dial bed while knitting on the very same long needles of the cylinder, or on every $1^{st}$ long needle of the 6 needle repeat that the previous feeds 2, 3 and 5 tucked to, and missing 5 long and short cylinder needles within the 6 needle repeat.

Feed 7 forms the seventh course in the 20 feed knitting sequence using yarn 240 and knits on all long and short needles of the cylinder while missing all long and short needles of the dial altogether and is identical to feed 4.

Feed 8 forms the eighth course in the 20 feed knitting sequence using yarn 240 and knits on all long and short needles of the cylinder while missing all long and short needles of the dial altogether and in the same manner is identical to feeds 4 and 7.

Feed 9 forms the ninth course of the 20 feed knitting sequence using yarn 240 and just like feeds 2, 3 and 5, is fed to the knitting elements essentially knitting on all long and short needles of the dial bed while tucking on only every $4^{th}$ short needle of the cylinder in every 6 needle repeat, and compared to feeds 2, 3 and 5, is off-set by three needles, or exactly half way off-set in relation to the every $1^{st}$ long needle within the 6 needle repeat that the previous feeds 2, 3 and 5 tucked to, and missing 5 long and short cylinder needles within the 6 needle repeat. This feed 9 of the 20 feed knitting sequence begins the formation of the mesh opening that is off-setting the placement of the hole exactly centered in between the mesh openings that are formed by the previous feeds 1, 2, 3, 5 and 6, thus producing the spaced off-set symmetrical mesh hole placement that is illustrated in this preferred embodiment of the present invention.

Feed 10 forms the tenth course in the 20 feed knitting sequence using yarn 240 and knits on all long and short needles of the cylinder while missing all long and short needles of the dial altogether and in the same manner is identical to feeds 4, 7 and 8.

Feed 11 forms the eleventh course of the 20 feed knitting sequence using yarn 220 as it is fed to the knitting elements between the dial and cylinder needle beds only to knit on every $4^{th}$ short needle within the 6 needle repeat of the cylinder needle bed, while missing all long and short needles of the dial as well as missing 5 long and short cylinder needles within the 6 needle repeat placing the yarn 220 into the mesh opening in the now re-positioned offset hole. This feed is exactly like feed 1 with the only difference being that the cylinder needle that is knitted to is exactly 3 needles offset difference from feed 1, placing the mesh opening in an off-set spaced relationship with the first series of feeds 1 thru 10 that comprise the initial mesh opening placement.

Feed 12 forms the twelfth course of the 20 feed knitting sequence using yarn 240 and is identical to feed 9, and is fed to the knitting elements essentially knitting on all long and short needles of the dial bed while tucking on only every $4^{th}$ short needle of the cylinder within every 6 needle repeat, and compares to feeds 2, 3 and 5, but just like feed 9 it is off-set by three needles, or exactly half way off-set in relation to the every $1^{st}$ long needle that the previous feeds 2, 3 and 5 tucked to, and missing 5 long and short cylinder needles within the 6 needle repeat.

Feed 13 forms the thirteenth course of the 20 feed knitting sequence using yarn 240 and is identical to feed 12 and feed 9, and is fed to the knitting elements essentially knitting on all long and short needles of the dial bed while tucking on only every $4^{th}$ short needle of the cylinder in every 6 needle repeat.

Feed 14 forms the fourteenth course in the 20 feed knitting sequence using yarn 240 and knits on all long and short needles of the cylinder while missing all long and short needles of the dial altogether and in the same manner is identical to feeds 4, 7, 8 and 10.

Feed 15 forms the fifteenth course of the 20 feed knitting sequence using yarn 240 and is identical to feeds 9, 12 and 13, and is fed to the knitting elements essentially knitting on all long and short needles of the dial bed while tucking on only every $4^{th}$ short needle of the cylinder within every 6 needle repeat.

Feed 16 forms the sixteenth course of the 20 feed knitting sequence using yarn 240 is identical to feed 6, except it is offset by 3 needles in the 6 needle repeat. Yarn 240 is fed to the knitting elements essentially knitting on all long and short needles of the dial bed while knitting on only every $4^{th}$ short needle of the cylinder within every 6 needle repeat, and compares to feed 6, but just like feeds 11, 12, 13 and 15 it is off-set by three needles compared to feed 6, or exactly half way off-set in relation to the every $1^{st}$ needle that the previous feed 6 knitted to, and missing 5 long and short cylinder needles within the 6 needle repeat.

Feed 17 forms the seventeenth course in the 20 feed knitting sequence using yarn 240 and knits on all long and short needles of the cylinder while missing all long and short needles of the dial altogether and in the same manner is identical to feeds 4, 7, 8, 10 and 14.

Feed 18 forms the eighteenth course in the 20 feed knitting sequence using yarn 240 and is identical to feed 17, and knits on all long and short needles of the cylinder while missing all long and short needles of the dial altogether and in the same manner is identical to feeds 4, 7, 8, 10, 14 and 17.

Feed 19 forms the nineteenth course of the 20 feed knitting sequence using yarn 240, as it is fed to the knitting elements essentially knitting on all long and short needles of the dial bed while tucking on the very same long needles of the cylinder, or on every 1 needle within the 12 needle repeat that the previous feeds 2, 3 and 5 tucked to, and missing 5 long and short cylinder needles within the 6 needle repeat, and is identical to feeds 2, 3 and 5. This feed 19 of the 20 feed knitting sequence begins the formation of the mesh opening that is off-setting the placement of the hole exactly centered in between the mesh openings that are formed by the previous feeds 9, 11, 12, 13, 15 and 16, thus producing the spaced symmetrical mesh hole placement that is illustrated in this preferred embodiment of the present invention.

Feed 20 forms the twentieth course in the 20 feed knitting sequence using yarn 240 and knits on all long and short needles of the cylinder while missing all long and short needles of the dial altogether and in the same manner is identical to feeds 4, 7, 8, 10, 14 17 and 18. This completes the 20 feed knit sequence and the subsequent knitting feeds positioned around the circular machine will repeat starting again with feed 1. It is further understood by one skilled in the art that depending on the diameter of the knitting machine and the number of available feed positions on that machine, and if the machine is cam driven and not Jacquard selected, an even number of repeats of the 20 feed knitting sequence must be adhered to so as to produce a continuous uninterrupted pattern result. For example 20, 40, 60, 80, 100, 120 or 140 available feeds will be required to be divisible by the 20 feed repeat evenly.

Figure 16:
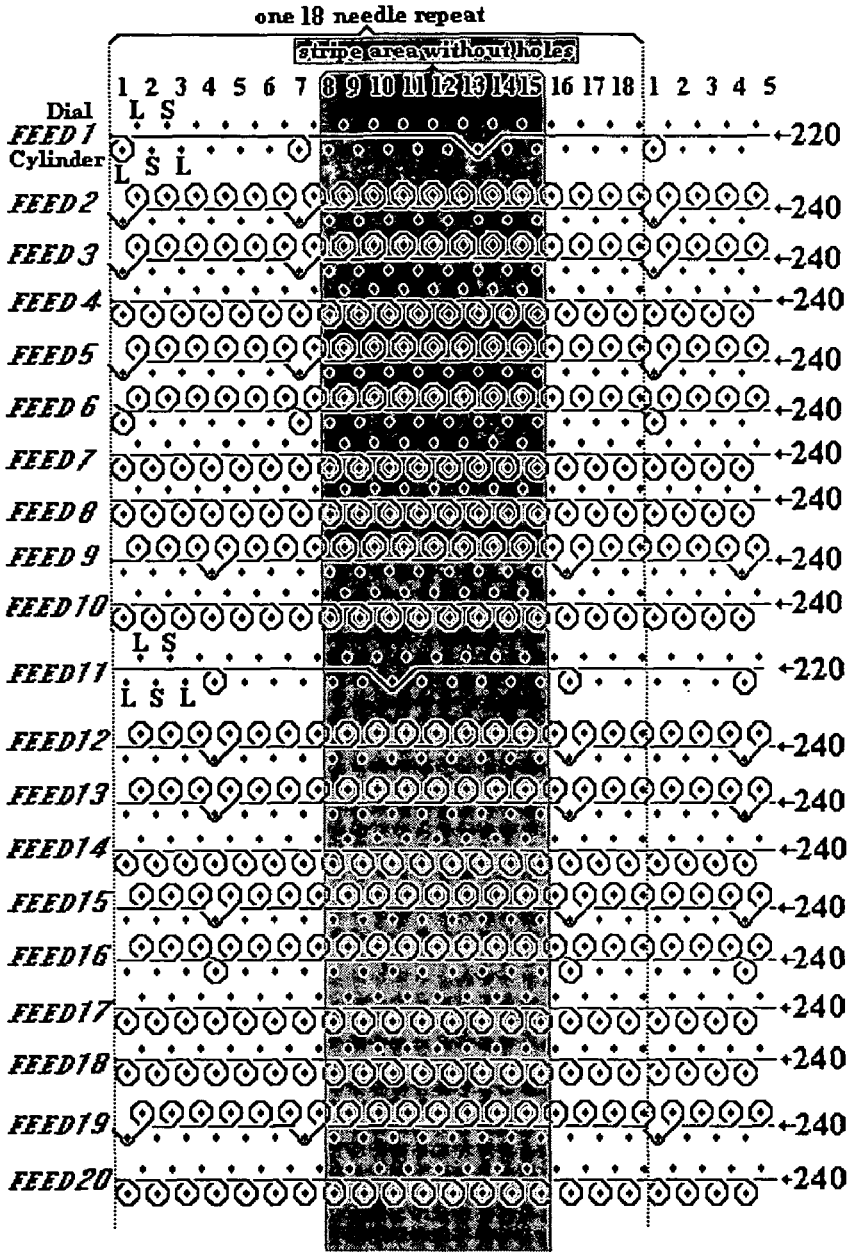
FIG. 16 shows a schematic diagram representing another embodiment of the knitting process of the present invention.

FIG. 16 shows a schematic diagram representing another embodiment of the knitting process of the present invention. FIG. 16 describes a 20 feed knitting sequence repeating on 18 needles, each feed knitting one course, creating a pattern repeat for forming a fabric according to the present invention.

FIG. 16 illustrates an alternate embodiment of the present invention described in FIG. 15. A fabric produced according to FIG. 16 will have openings in a geometric diamond shaped half drop motif, essentially spacing the openings at the same intervals as in the design of FIG. 15, and in addition will have a lineal stripe effect of solid fabric area on both face and back surfaces of the fabric simultaneously, accomplished by removal of mesh hole openings in the pattern repeat, thereby providing a solid fabric surface without holes in a designated area of the pattern repeat forming a vertical stripe along the fabric length. In this way, there is created both a more breathable fabric performance, while incorporating, preferably integrally, portion without a plurality of holes. The portion without a plurality of holes may be a solid stripe fabric area or areas on both face and back surfaces with enough density to satisfy printing different colors on both sides without an objectionable grin-thru of one color through the other fabric surface. While a lineal stripe is depicted, those skilled in the art will recognize that multiple stripes or other shapes or patterns are within the scope of the present invention.

FIG. 16 is by way of example only, and for the purposes of brevity, demonstrates the alternating mesh hole and solid area stripe technique based on a small 18 needle repeat in width, however, the present invention is not limited to such a small design repeat, and one skilled in the art would know that the possibilities of widths of each stripe and the selected distance across the fabric width between said stripes is essentially unlimited in scope.

Feed 1 forms the first course of the 20 feed knitting sequence using yarn 220 as it is fed to the knitting elements between the dial and cylinder needle beds only to knit on every $1^{st}$ long needle and $7^{th}$ long needle of the 18 needle repeat on the cylinder bed, and only tucking on the $13^{th}$ cylinder needle, while missing all long and short needles of the dial as well as missing long and short cylinder needles 2 thru 6, 8 thru 12, and 14 thru 18 within the 18 needle repeat. The yarn 220 is described as a substantially transparent and relatively fine denier synthetic continuous monofilament polyester yarn, such as 20 denier clear or semi-dull luster in a round cross-section, in denier range of between 15 and 30 denier, preferably 20 denier chosen for reasons of maximizing the ability to visually see through the fabric in selected locations according to the fabric construction, thus accentuating a mesh like fabric result, especially when used in combination with a substantially heavier denier yarn possessing opaque properties that comprise the majority percentage of the fabric constituting the solid areas.

Feeds 2 and 3 are identical to each other and form the second and third courses of the knitting sequence using yarn 240 as it is fed to the knitting elements essentially knitting on all long and short needles of the dial bed while tucking on the very same long needles of the cylinder, or on every $1^{st}$ and $7^{th}$ long needle of the 18 needle repeat that the previous feed 1 knitted to, and missing all other long and short cylinder needles within the 18 needle repeat. The yarn 240 is described as a substantially opaque heavier denier textured synthetic continuous multifilament polyester yarn in a range between 100 and 200 denier such as 150 denier semi-dull round cross-section with a relatively high number of filaments in the yarn bundle in a range of between 68 and 216 filaments, preferably 96 to 136 filaments, and chosen for reasons of creating a high density fabric quality with a closed or tight fabric face so as to serve as a blocker to color transfer through the fabric to the reverse face surface when the fabric is sublimation printed. The higher filament count also increases the wick ability of perspiration to be transported away from the body skin surface of the wearer of a garment comprised of the present invention, and moves the moisture to the outer surface of the garment.

Feed 4 forms the fourth course in the 20 feed knitting sequence using yarn 240 and knits on all long and short needles of the cylinder while missing all long and short needles of the dial altogether.

Feed 5 forms the fifth course of the 20 feed knitting sequence using yarn 240, as it is fed to the knitting elements essentially knitting on all long and short needles of the dial bed while tucking on the very same $1^{st}$ and $7^{th}$ long cylinder needles of the 18 needle repeat that the previous feeds 2 and 3 tucked to, and missing all other long and short cylinder needles within the 18 needle repeat, and is identical to feeds 2 and 3. Feed 6 forms the sixth course of the 20 feed knitting sequence using yarn 240, as it is fed to the knitting elements essentially knitting on all long and short needles of the dial bed while knitting on the very same $1^{st}$ and $7^{th}$ long needles of the cylinder, in the 18 needle repeat that the previous feeds 2, 3 and 5 tucked to, and missing all other long and short cylinder needles within the 18 needle repeat.

Feed 7 forms the seventh course in the 20 feed knitting sequence using yarn 240 and knits on all long and short needles of the cylinder while missing all long and short needles of the dial altogether and is identical to feed 4.

Feed 8 forms the eighth course in the 20 feed knitting sequence using yarn 240 and knits on all long and short needles of the cylinder while missing all long and short needles of the dial altogether and in the same manner is identical to feeds 4 and 7.

Feed 9 forms the ninth course of the 20 feed knitting sequence using yarn 240 and just like feeds 2, 3 and 5, is fed to the knitting elements essentially knitting on all long and short needles of the dial bed while tucking on only every $4^{th}$ and $16^{th}$ short needle of the cylinder in every 18 needle repeat, and compared to feeds 2, 3 and 5, is off-set by three needles, or exactly half way off-set in relation to the every $1^{st}$ and $7^{th}$ long needle within the 18 needle repeat that the previous feeds 2, 3 and 5 tucked to, and missing all other long and short cylinder needles within the 18 needle repeat. This feed 9 of the 20 feed knitting sequence begins the continuation of the solid stripe area between needles 8 thru 15, and moves the openings that are off-setting the placement of the holes exactly centered in between the mesh openings that are formed by the previous feeds 1, 2, 3, 5 and 6, thus producing the spaced off-set symmetrical mesh hole placement that is illustrated in this preferred embodiment of the present invention.

Feed 10 forms the tenth course in the 20 feed knitting sequence using yarn 240 and knits on all long and short needles of the cylinder while missing all long and short needles of the dial altogether and in the same manner is identical to feeds 4, 7 and 8.

Feed 11 forms the eleventh course of the 20 feed knitting sequence using yarn 220 as it is fed to the knitting elements between the dial and cylinder needle beds only to knit on every $4^{th}$ and $16^{th}$ short needle, and only tuck on the $10^{th}$ needle within the 18 needle repeat of the cylinder needle bed, while missing all long and short needles of the dial as well as missing long and short cylinder needles 1 thru 3, 5 thru 9, 11 thru 15, and 17 thru 18 within the 18 needle repeat placing the yarn 220 into the mesh opening in the now re-positioned offset hole. This feed is exactly like feed 1 with the only difference being that the cylinder needle that is knitted to is exactly 3 needles offset difference from feed 1, placing the mesh opening in an off-set spaced relationship with the first series of feeds 1 thru 6 that comprise the initial mesh opening placement.

Feed 12 forms the twelfth course of the 20 feed knitting sequence using yarn 240 and is identical to feed 9, and is fed to the knitting elements essentially knitting on all long and short needles of the dial bed while tucking on only every $4^{th}$ and $16^{th}$ short needle of the cylinder within every 18 needle repeat, and compares to feeds 2, 3 and 5, but just like feed 9 it is off-set by three needles, or exactly half way off-set in relation to the every $1^{st}$ and $7^{th}$ long needle that the previous feeds 2, 3 and 5 tucked to, and missing all other long and short cylinder needles within the 18 needle repeat.

Feed 13 forms the thirteenth course of the 20 feed knitting sequence using yarn 240 and is identical to feed 12 and feed 9, and is fed to the knitting elements essentially knitting on all long and short needles of the dial bed while tucking on only every $4^{th}$ and $16^{th}$ short needle of the cylinder, while missing all other long and short cylinder needles in every 18 needle repeat.

Feed 14 forms the fourteenth course in the 20 feed knitting sequence using yarn 240 and knits on all long and short needles of the cylinder while missing all long and short needles of the dial altogether and in the same manner is identical to feeds 4, 7, 8 and 10.

Feed 15 forms the fifteenth course of the 20 feed knitting sequence using yarn 240 and is identical to feeds 9, 12 and 13, and is fed to the knitting elements essentially knitting on all long and short needles of the dial bed while tucking on only every $4^{th}$ and $16^{th}$ short needle of the cylinder, while missing all other long and short cylinder needles within every 18 needle repeat.

Feed 16 forms the sixteenth course of the 20 feed knitting sequence using yarn 240 is identical to feed 6, except it is offset by 3 needles in the 18 needle repeat. Yarn 240 is fed to the knitting elements essentially knitting on all long and short needles of the dial bed while knitting on only every $4^{th}$ and $16^{th}$ short needle of the cylinder within every 18 needle repeat, and compares to feed 6, but just like feeds 11, 12, 13 and 15 it is off-set by three needles compared to feed 6, or exactly half way off-set in relation to the every $1^{st}$ and $7^{th}$ needle that the previous feed 6 knitted to, and missing all other long and short cylinder needles within the 18 needle repeat.

Feed 17 forms the seventeenth course in the 20 feed knitting sequence using yarn 240 and knits on all long and short needles of the cylinder while missing all long and short needles of the dial altogether and in the same manner is identical to feeds 4, 7, 8, 10 and 14.

Feed 18 forms the eighteenth course in the 20 feed knitting sequence using yarn 240 and is identical to feed 17, and knits on all long and short needles of the cylinder while missing all long and short needles of the dial altogether and in the same manner is identical to feeds 4, 7, 8, 10, 14 and 17.

Feed 19 forms the nineteenth course of the 20 feed knitting sequence using yarn 240, as it is fed to the knitting elements essentially knitting on all long and short needles of the dial bed while tucking on the very same long needles of the cylinder, or on every $1^{st}$ and $7^{th}$ needle within the 18 needle repeat that the previous feeds 2, 3 and 5 tucked to, and missing other long and short cylinder needles within the 18 needle repeat, and is identical to feeds 2, 3 and 5. This feed 19 of the 20 feed knitting sequence begins the formation of the mesh opening that is off-setting the placement of the hole exactly centered in between the mesh openings that are formed by the previous feeds 9, 11, 12, 13, 15 and 16, thus producing the spaced symmetrical mesh hole placement that is illustrated in this preferred embodiment of the present invention.

Feed 20 forms the twentieth course in the 20 feed knitting sequence using yarn 240 and knits on all long and short needles of the cylinder while missing all long and short needles of the dial altogether and in the same manner is identical to feeds 4, 7, 8, 10, 14 17 and 18. This completes the 20 feed knit sequence and the subsequent knitting feeds positioned around the circular machine will repeat starting again with feed 1. It is further understood by one skilled in the art that depending on the diameter of the knitting machine and the number of available feed positions on that machine, and if the machine is cam driven and not Jacquard selected, an even number of repeats of the 20 feed knitting sequence must be adhered to so as to produce a continuous uninterrupted pattern result. For example 20, 40, 60, 80, 100, 120 or 140 available feeds will be required to be divisible by the 20 feed repeat evenly.

Figure 17:
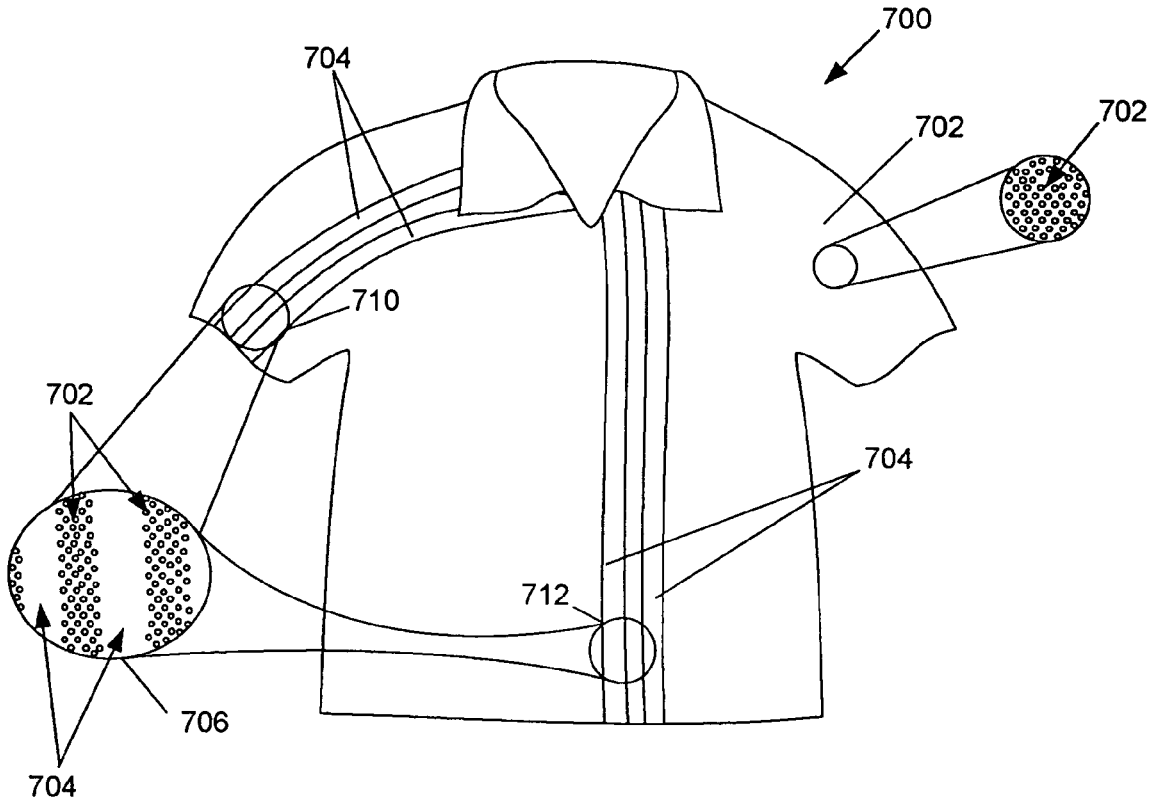
FIG. 17 shows a garment of another embodiment of the present invention.

FIG. 17 shows a garment 700 of another embodiment of the present invention, for example, a garment constructed of fabric knit, in part, according to the schematic of FIG. 16. Garment 700 includes portions including a plurality of openings 702 (openings not depicted in the full view) and portions 704 without openings adjacent to portions having a plurality of openings. A close-up view 706 of the fabric of garment 700 may be considered to be a close-up of sleeve portion 704 or of shirt front portion 712. The sleeve portion, shirt portion and close-up, however, are not intended to impart any limitation on the position of either the plurality of openings or of adjacent portions without openings.

As can be seen in close-up 706, portions without openings 704 appear as visually distinct stripes when compared to portions with openings 702. Preferably, these portions without openings are adjacent to openings, and more preferably, portions with openings and portions without openings are integrally knit. Portions without openings create a different surface for printing, change the look of the finished garment, allow for incorporation of graphical or alphanumeric features, e.g., trademarks, into finished garments, and may affect the salability of the finished garment.

Certain modifications and improvements will occur to those skilled in the art upon a reading of the foregoing description. By way of example, those skilled in the art may desire to increase or decrease the number or frequency of openings to further increase comfort or breathability. Such modifications may reduce fabric weight. Such modifications may also allow for the use of heavier denier yarns. Further, coarser gauge or open fabric structures could be used to minimize fabric weight. Also, finer denier yarns could be used in a tighter fabric structure or with finer gauges, such as 28 or 32 gauges. Such modifications may allow for fabric density sufficient to achieve printing without color grin-through. It should be understood that all such modifications and improvements have been deleted herein for the sake of conciseness and readability but are properly within the scope of the following claims.

We claim:

1. A double face, weft-knit fabric comprising:

a first face having a printable portion;

a second face having a printable portion, wherein the fabric density of the fabric is greater than about 5 oz. per square yard, thereby substantially preventing grin through from at least one printable portion to the opposite face;

a plurality of openings formed in both faces for breathability;

wherein both said first face and said second face include at least two adjacent courses, each of said at least two courses being knit of at least one second yarn to form at least four consecutive knitted loops by at least four adjacent needles, and at least one opening-yarn positioned in each of said plurality of openings for facilitating said openings, wherein said at least one opening-yarn is laid-in in between said first face and said second face for at least four of said adjacent knitted loops and forms a knitted loop on either said first or said second face.

2. The fabric of claim 1, wherein the fabric is integrally knit.

3. The fabric of claim 2, wherein the knitting machine is a double knit machine.

4. The fabric of claim 1, wherein the fabric is at least partially knitted of synthetic yarn.

5. The fabric of claim 4, wherein the fabric is substantially 100% synthetic yarn.

6. The fabric of claim 4, wherein the synthetic yarn is polyester.

7. The fabric of claim 1, wherein the openings are substantially symmetrical.

8. The fabric of claim 1, wherein the openings are spaced apart from one another.

9. The fabric of claim 8, wherein the openings are horizontally and vertically spaced apart from one another.

10. The fabric of claim 9, wherein the openings are substantially equally spaced in the horizontal direction and substantially equally spaced in the vertical direction at a different spacing.

11. The fabric of claim 8, wherein the openings are substantially equally spaced apart.

12. The fabric of claim 1, wherein the at least one opening-yarn includes a synthetic monofilament yarn having a substantially round cross-section and having a luster between about substantially clear to substantially semi-dull.

13. The fabric of claim 1, wherein the denier of the at least one opening-yarn is less that the denier of the second yarn.

14. The fabric of claim 13, wherein the denier of the at least one opening-yarn is between about 15 and 30.

15. The fabric of claim 1, wherein the at least one second yarn is a textured yarn.

16. The fabric of claim 1, wherein the at least one second yarn is a multifilament yarn.

17. The fabric of claim 1, wherein the at least one second yarn is semi-dull.

18. The fabric of claim 1, wherein the at least one second yarn has a round cross-section.

19. The fabric of claim 1, wherein the denier of the at least one second yarn is between about 100 and 200.

20. The fabric of claim 19, wherein the denier of the at least one second yarn is about 150.

21. The fabric of claim 1, wherein the first face and the second face are comprised of technical face loops.

22. The fabric of claim 1, wherein the first and second face have a substantially identical stitch density.

23. The fabric of claim 22, wherein the first and second face have a stitch density of between about 1300 and 1700 stitches per square inch.

24. The fabric of claim 23, wherein the first and second face have a stitch density of about 1500 stitches per square inch.

25. The fabric of claim 1, wherein the fabric density is between about 6 and 7 oz. per square yard.

26. The fabric of claim 25, wherein the fabric density is between about 6.2 and 6.7 oz. per square yard.

27. The fabric of claim 26, wherein the fabric density is between about 6.3 and 6.6 oz. per square yard.

28. The fabric of claim 1, wherein the openings are between about ½ mm and 3 mm at their widest point.

29. The fabric of claim 1, further including at least one portion without openings adjacent to said plurality of openings.

30. A double face, weft-knit textile garment comprising:

a first face having a printed portion;

a second face having a printed portion, wherein the fabric density of the fabric forming the garment is greater than about 5 oz. per square yard, thereby substantially preventing grin through from at least one printed portion to the opposite face, wherein both said first face and said second face include at least two adjacent courses, each of said at least two courses being knit of at least one second yarn to form at least four consecutive knitted loops by at least four adjacent needles;

a plurality of openings formed in both faces for breathability, wherein said openings are weft-knit with at least one opening-yarn, wherein said at least one opening-yarn is laid-in in between said first face and said second face for at least four of said adjacent knitted loops and forms a knitted loop on either said first or said second face; and a body anchor for facilitating attachment of the garment to the wearer.

31. The textile garment of claim 30, wherein the body anchor is a head opening.

32. The textile garment of claim 30, wherein the textile article is a poncho.

33. The textile garment of claim 30, wherein the body anchor is a torso opening.

34. The textile garment of claim 33, wherein the textile article is a pair of bottoms selected from the group consisting of skirt, kilt, shorts and pants.

35. The textile garment of claim 30, wherein the body anchor is at least one arm opening.

36. The textile garment of claim 35, wherein the textile article is a shirt selected from the group consisting of long sleeve, short sleeve, jersey, vest, jacket and coat.

37. The textile garment of claim 30, wherein the fabric is integrally knit.

38. The textile garment of claim 37, wherein the knitting machine is a double knit machine.

39. The textile garment of claim 30, wherein the fabric is at least partially knitted of synthetic yarn.

40. The textile garment of claim 39, wherein the fabric is substantially 100% synthetic yarn.

41. The textile garment of claim 39, wherein the synthetic yarn is polyester.

42. The textile garment of claim 30, wherein the openings are substantially symmetrical.

43. The textile garment of claim 30, wherein the openings are spaced apart from one another.

44. The textile garment of claim 43, wherein the openings are horizontally and vertically spaced apart from one another.

45. The textile garment of claim 44, wherein the openings are substantially equally spaced in the horizontal direction and substantially equally spaced in the vertical direction at a different spacing.

46. The textile garment of claim 43, wherein the openings are substantially equally spaced apart.

47. The textile garment of claim 30, wherein the at least one opening yarn includes a synthetic monofilament yarn having a substantially round cross-section and having a luster between about substantially clear to substantially semi-dull.

48. The textile garment of claim 30, wherein the denier of the at least one opening yarn is less than the denier of the second yarn.

49. The textile garment of claim 48, wherein the denier of the at least one opening yarn is between about 15 and 30.

50. The textile garment of claim 30, wherein the at least one second yarn is a textured yarn.

51. The textile garment of claim 50, wherein the at least one second yarn is a multifilament yarn.

52. The textile garment of claim 30, wherein the at least one second yarn is semi-dull.

53. The textile garment of claim 30, wherein the at least one second yarn has a round cross-section.

54. The textile garment of claim 30, wherein the denier of the at least one second yarn is between about 100 and 200.

55. The textile garment of claim 54, wherein the denier of the second yarn is about 150.

56. The textile garment of claim 30, wherein the first face and the second face are comprised of technical face loops.

57. The textile garment of claim 30, wherein the first and second face have a substantially identical stitch density.

58. The textile garment of claim 57, wherein the first and second face have a stitch density of between about 1300 and 1700 stitches per square inch.

59. The textile garment of claim 58, wherein the first and second face have a stitch density of about 1500 stitches per square inch.

60. The textile garment of claim 30, wherein the fabric density is between about 6 and 7 oz. per square yard.

61. The textile garment of claim 60, wherein the fabric density is between about 6.2 and 6.7 oz. per square yard.

62. The textile garment of claim 61, wherein the fabric density is between about 6.3 and 6.6 oz. per square yard.

63. The textile garment of claim 30, wherein the openings are between about ½ mm and 3 mm at their widest point.

64. The textile garment of claim 30, further including at least one portion without a plurality of openings adjacent to and integrally knit with said portion having a plurality of openings.

65. A double face, weft-knit fabric comprising:

an opening-yarn knitted to form technical face loops on at least one face of said fabric, said opening-yarn having a luster between about substantially clear to substantially semi-dull, and a denier of between about 15 and 30;

a second yarn knitted to form technical face loops on both fabric faces, said second yarn having multiple filaments, and a denier of between about 100 and 200, wherein said opening-yarn and second yarn are knitted to have a stitch density of between about 1300 and 1700 stitches per square inch, wherein both of said faces include at least two adjacent courses, each of the at least two courses being knit of at least one second yarn to form at least four consecutive knitted loops by at least four adjacent needles, wherein said at least one opening-yarn is laid-in in between said faces for at least four of said adjacent knitted loops and; and a plurality of openings between about ½ mm and 3 mm at their widest point, said openings defined at their perimeter by a tuck of said second yarn, and maintained at a desired size or shape by at least a portion of said opening-yarn positioned across said opening, thereby forming a fabric having a density between about 6 and 7 oz. per square yard that is printable on both faces, substantially prevents grin through, and is breathable.

66. The textile garment of claim 30, wherein at least one of the plurality of openings is defined at least in part by a tuck of at least one of the second yarns of the first or second face to the opposite face, and by a knitted loop of at least one of the opening-yarns.

67. The fabric of claim 1, wherein at least one of the plurality of openings is defined at least in part by a tuck of at least one of the second yarns of the first or second face to the opposite face, and by a knitted loop of at least one of the opening-yarns.

* * * * *

UNITED STATES PATENT AND TRADEMARK OFFICE

CERTIFICATE OF CORRECTION

PATENT NO. : 7,788,953 B2
APPLICATION NO. : 11/591714
DATED : September 7, 2010
INVENTOR(S) : McMurray et al.

It is certified that error appears in the above-identified patent and that said Letters Patent is hereby corrected as shown below:

In Column 6, Line 14, shorts 308 should be "dress 308"

In Column 9, Line 63, the word Feed should be indented to begin a new paragraph

In Column 20, Line 9, the word long should not be printed in superscript

In Column 21, Line 47, 1 needle should read "1st needle"

Signed and Sealed this

Twenty-sixth Day of October, 2010

David J. Kappos

David J. Kappos
*Director of the United States Patent and Trademark Office*